US007089769B2

(12) United States Patent
Lim et al.

(10) Patent No.: US 7,089,769 B2
(45) Date of Patent: Aug. 15, 2006

(54) DIRECT DRIVE WASHING MACHINE

(75) Inventors: Hee-Tae Lim, Incheon (KR); Jae-Won Chang, Gunpo (KR); Dong-Won Kim, Gwangmyeong (KR)

(73) Assignee: LG Electronics Inc., Seoul (KR)

( * ) Notice: Subject to any disclaimer, the term of this patent is extended or adjusted under 35 U.S.C. 154(b) by 753 days.

(21) Appl. No.: 10/137,264

(22) Filed: May 3, 2002

(65) Prior Publication Data

US 2002/0166349 A1 Nov. 14, 2002

(30) Foreign Application Priority Data

May 8, 2001 (KR) ..... 2001-24907
May 8, 2001 (KR) ..... 2001-24912
May 8, 2001 (KR) ..... 2001-24913
Jun. 9, 2001 (KR) ..... 2001-32332

(51) Int. Cl.
*D06F 37/30* (2006.01)

(52) U.S. Cl. ..... 68/23.6; 68/133; 192/69.8

(58) Field of Classification Search ..... 68/23.6, 68/23.7, 133; 192/69.8, 71, 79, 84.6
See application file for complete search history.

(56) References Cited

U.S. PATENT DOCUMENTS 5,737,944 A * 4/1998 Nishimura et al. ..... 68/23.7
5,778,703 A * 7/1998 Imai et al. ..... 68/12.02
5,887,458 A * 3/1999 Bae ..... 68/23.7
6,049,930 A * 4/2000 Hisano et al. ..... 8/159
6,176,108 B1 * 1/2001 Bae et al. ..... 68/23.7
6,332,343 B1 * 12/2001 Koketsu et al. ..... 68/23.7

* cited by examiner

*Primary Examiner*—Joseph L. Perrin
(74) *Attorney, Agent, or Firm*—Birch, Stewart, Kolasch & Birch, LLP

(57) ABSTRACT

In a direct drive washing machine having a driving motor installed at a lower portion of an outer tub and rotating an inner tub or a pulsator by the driving motor, a pulsator shaft and a tub shaft are constructed with a dual shaft structure, respectively connected to the inner tub and the pulsator and transmitting a rotational force of the driving motor thereto, a clutch coupling being connected with an outer circumference of the tub shaft and performing a clutching operation by being connected with/separated from a rotor of the driving motor while moving up and down, and with a clutch actuator providing a force to the clutch coupling so as to separate it from the rotor, whereby it is possible to wash laundry by various methods in accordance with laundry conditions, and accordingly, the performance of washing can be improved and a load on the driving motor can be lowered.

10 Claims, 23 Drawing Sheets

DIRECT DRIVE WASHING MACHINE

BACKGROUND OF THE INVENTION

1. Field of the Invention

The present invention relates to a direct drive type washing machine which is capable of rotating an inner tub or a pulsator directly by a driving motor installed at the lower portion of an outer tub, and in particular to a direct drive washing machine which is capable of selectively rotating the inner tub through a clutch device coupling the driving force from the motor.

2. Description of the Background Art

As depicted in FIG. 1, the conventional direct drive washing machine includes a casing 1 having an opened upper portion, an outer tub 3 placed inside the casing 1 and supported by a plurality of supporting rods 2 (only one of which is shown) and for containing wash water, an inner tub 5 rotatively installed inside the outer tub 3 for receiving laundry therein, and a driving motor 9 installed at the lower portion of the outer tub 3 and rotating the inner tub 5 through an inter connecting tub shaft 6.

A pulsator 7, also called an agitator, is installed inside the inner tub 5 in order to form a wash water current.

In the conventional direct drive washing machine, the pulsator 7 and the inner tub 5 are rotated as one body by the driving motor 9, and a relative movement is generated between the wash water and the laundry and accordingly the laundry can be washed.

However, in the conventional direct drive washing machine, because washing is performed by rotating the inner tub 5 regardless of the kind and the load of clothes and the quantity of wash water, when the amount of clothes loaded is relatively small, the laundry is rotated in the same direction as the inner tub 5, and accordingly the relative movement between the water and the laundry may not be generated well and the washing efficiency may be lowered.

In addition, in the conventional direct drive washing machine, when washing is performed by rotating the inner tub 5, it may have a relatively larger inertia force than a type performing washing by rotating only a pulsator, and accordingly the load on the driving motor 9 is increased and the driving efficiency may consequently be lowered.

SUMMARY OF THE INVENTION

In order to solve the above-mentioned problems, it is an object of the present invention to provide a direct drive washing machine which is capable of improving a detergency by performing washing by various methods in accordance with washing conditions by installing a clutch device in order to rotate only a pulsator or rotate the pulsator and an inner tub simultaneously.

In addition, it is another object of the present invention to provide a direct drive washing machine which is capable of reducing the load on a driving motor by selectively rotating an inner tub.

In order to achieve the above-mentioned objects, a direct drive washing machine in accordance with the present invention includes an outer tub for storing wash water therein; an inner tub rotatable inside the outer tub, for receiving laundry therein; a pulsator rotatable inside the inner tub so as to be performable a relative rotation about the inner tub; a driving motor installed at a lower portion of the outer tub, for rotating the pulsator and the inner tub; a pulsator shaft directly connected between a rotor of the driving motor and the pulsator; a tub shaft connected to the inner tub and separated from the driving motor; a clutch coupling connecting and disconnecting the tub shaft which is carried rotatably on the pulsator shaft and the rotor of the driving motor by performing a clutching operation while moving up and down; and a clutch actuator actuating the clutch coupling so as to connect and separate it from the rotor of the driving motor.

The direct drive washing machine further includes an elastic member providing an actuating force to the clutch coupling so as to urge it in to connection with the rotor of the driving motor.

A fixed member is installed to the bottom surface of the outer tub, and a tub rotation brake means is placed between the fixed member and the clutch coupling in order to restrict a rotation of the inner tub when the clutch coupling is separated from the rotor of the driving motor and moved upwardly.

In order to achieve the above-mentioned objects, a direct drive washing machine in accordance with an embodiment of the present invention includes an outer tub housed inside a casing, for storing wash water therein; an inner tub rotatable inside the outer tub, for receiving laundry therein; a pulsator rotatable inside the inner tub; a driving motor installed at a lower portion of the outer tub for rotating the pulsator and the inner tub, a pulsator shaft directly connected between a rotor of the driving motor and the pulsator; a tub shaft carried rotatably on the pulsator shaft and connected to the inner tub and separated from the rotor of the driving motor; a clutch coupling connecting and disconnecting the tub shaft and the rotor of the driving motor by performing a clutching operation while moving up and down; a clutch lever having one end thereof pivotably mounted to the lower portion of the outer tub and moving the clutch coupling upwardly and downwardly while being pivoted upwardly and downwardly; and an lever operating means connected to an other end of the clutch lever for moving the clutch lever upwardly and downwardly.

The lever operating means includes a clutch motor installed to a fixed part of the washing machine, a winding pulley combined with a shaft of the clutch motor, and a wire connected between the winding pulley and the clutch lever.

The lever operating means includes a clutch motor installed to a fixed part of the washing machine; a winding pulley connected with a shaft of the clutch motor; and a wire connected between the winding pulley and the clutch lever.

A lever bracket is installed to a bottom surface of the outer tub so as to connect to the clutch lever rotatively, and an elastic member is positioned at a connection portion between the clutch lever and the lever bracket in order to apply a force to the clutch lever in the opposite direction to a force applied from the lever operating means to the clutch lever.

A protruding toothed portion and an engaging groove are respectively formed at the lever bracket and the clutch coupling in order to restrict a rotation of the inner tub by engaging each other when the clutch coupling is separated from the rotor of the driving motor and moved upwardly.

In order to achieve the above-mentioned objects, a direct drive washing machine in accordance with another embodiment of the present invention includes an outer tub housed inside a casing, for storing wash water therein; an inner tub rotatable inside the outer tub, for receiving laundry therein; a pulsator rotatable inside the inner tub; a driving motor installed at a lower portion of the outer tub for rotating the pulsator and the inner tub; a pulsator shaft directly connected between a rotor of the driving motor and the pulsator; a tub shaft carried rotatably on the pulsator shaft and connected to the inner tub and separated from the rotor of the driving motor; a clutch coupling connected with an outer circumference of the tub shaft and performing a clutch operation by being combined with/separated from the rotor of the driving motor while moving up and down; and a solenoid actuator installed at an outer circumference of the clutch coupling and moving the clutch coupling up and down by an electro-magnetic force.

The clutch coupling includes a splined coupling made of a non-magnetic material and connected with the pulsator shaft; and a magnetic coupling made of a magnetic material so as to respond to the electromagnetic force generated by the solenoid actuator and being fixed to an outer circumference of the splined coupling.

The solenoid actuator includes a solenoid coil wound around an outer circumference of the clutch coupling and forming a magnetic field, and a solenoid casing fixed to the lower portion of the outer tub and supporting the solenoid coil.

A tub rotation brake means is placed between the clutch coupling and the solenoid actuator in order to restrict a rotation of the inner tub when the clutch coupling is separated from the rotor and moved upwardly.

In order to achieve the above-mentioned objects, a direct drive washing machine in accordance with yet another embodiment of the present invention includes an outer tub housed inside a casing, for storing wash water therein; an inner tub rotatable inside the outer tub, for receiving laundry therein; a pulsator rotatable inside the inner tub; a driving motor installed at a lower portion of the outer tub for rotating the pulsator and the inner tub; a pulsator shaft directly connected between a rotor of the driving motor and the pulsator; a tub shaft carried rotatably on the pulsator shaft and connected to the inner tub and separated from the rotor of the driving motor; a clutch coupling having a sloping side at a lateral surface thereof, connected with an outer circumference of the tub shaft and performing a clutching operation while by being combined with/separated from the rotor of the driving motor while moving up and down; a plurality of clutch levers moving the clutch coupling up and down by being tightly contacted to/separated from the sloping side of the clutch coupling; and a lever operating means for tightly contacting/separating the clutch lever to/from the clutch coupling.

The direct drive washing machine further includes an elastic member applying a force to the clutch lever in the opposite direction to a force applied from the lever opening means to the clutch lever.

The sloping side of the coupling is constructed with a plurality of slanted ribs separated from each other along the circumferential direction of the coupling.

The plurality of clutch levers are constructed as a pair of clutch levers pivotably fixed to a fixed member of the outer tub and tightly contacted/separated to/from the both sides of the coupling while pivoting at the same time when one clutch lever is pivoted by the lever driving means.

Herein, the pair of clutch levers interlock mutually by respective sector gear teeth at a pivot hub portion thereof so as to engage with each other.

Differently, it is also possible the pair of clutch levers are combined each other by a rotating linkage means, and the rotating linkage means is constructed with a first arm and a second arm respectively extended from each clutch lever so as to face each other and having a slot at the overlapped end portion and a linkage pin connecting the first and the second arms by being combined with each slot of the first and the second arms so as to be performable a relative motion.

The fixed member includes a linkage guide in order to guide the linkage pin so as to slide linearly.

The linkage pin is formed with an 'L' shape.

A drain valve is installed at the bottom surface of the outer tub so as to be opened/closed in order to discharge wash water, a drain motor is installed at the bottom surface of the outer tub so as to be connected to the drain valve through a connecting link in order to operate the drain valve, and the lever operating means is operated by a driving force of the drain motor by connecting the clutch lever with the connecting link connecting the drain motor and the drain valve.

The drain motor moves the connecting link to a power off position at which the drain valve is closed and the clutch lever exerts a force pushing up the coupling, a first step position at which the drain valve is closed and the clutch lever does not exert the force pushing up the coupling, and a second step position at which the drain valve is opened and the clutch lever does not push up on the coupling.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Hereinafter, embodiments of a direct drive washing machine in accordance with the present invention will be described with reference to accompanying drawings.

Figure 1:
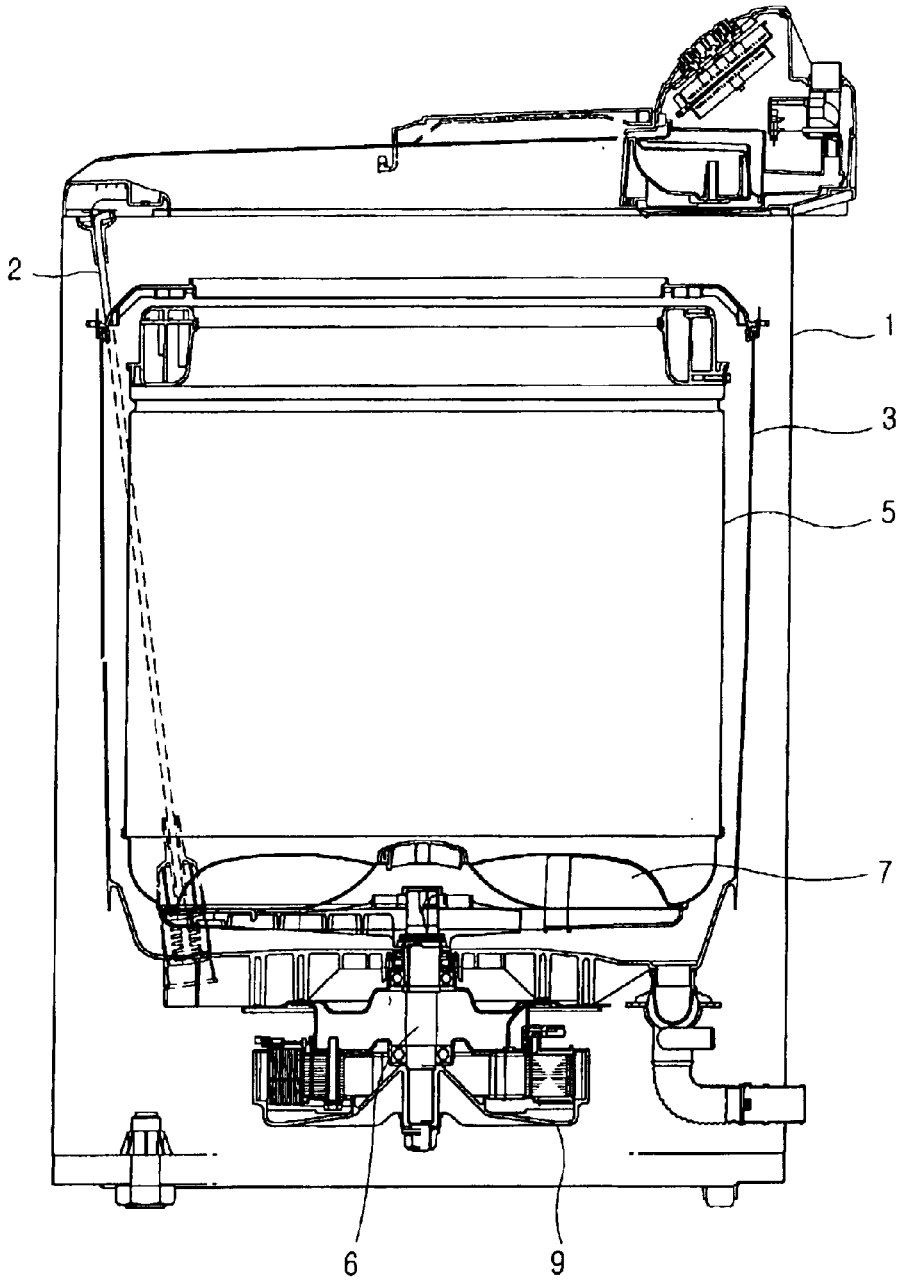
FIG. 1 CONVENTIONAL ART
FIG. 1 is a longitudinal cross-sectional view illustrating a conventional direct drive washing machine.
Figure 2:
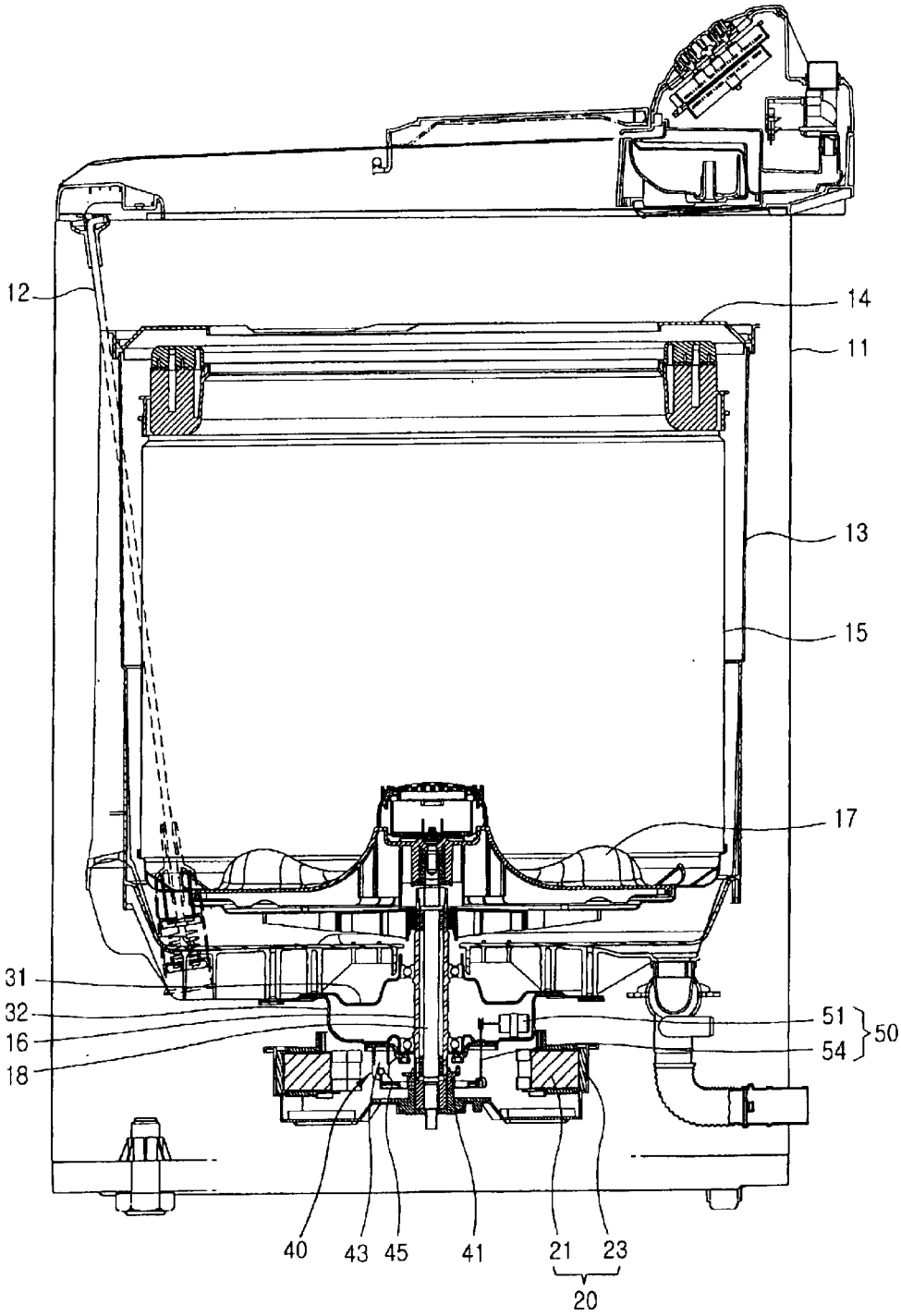
FIG. 2 is a longitudinal cross-sectional view illustrating a direct drive washing machine in accordance with a first embodiment of the present invention.

As depicted in FIG. 2, a direct drive washing machine in accordance with a first embodiment of the present invention includes a casing 11 having a rectangular or cylindrical shape, an outer tub 13 housed inside the casing 11 for containing wash water, an inner tub 15 rotatively installed inside the outer tub 13 for receiving laundry, a pulsator 17 installed inside the inner tub 15 so as to be capable of a relative rotation within the inner tub 15 for forming a wash water current, a driving motor 20 installed at the lower portion of the outer tub 13 and generating a rotational force in order to rotate the pulsator 17 and the inner tub 15, a pulsator shaft 18 and a tub shaft 16 formed as a dual shaft structure in order to transmit the rotational force by respectively being connected between the driving motor 20 and the pulsator 17 and the driving motor and the inner tub 15, and a clutch device 40 installed between the outer tub 13 and the driving motor 20 and coupling/uncoupling the rotational force from the driving motor 20 to the inner tub 15.

The major structural parts of the direct drive washing machine in accordance with the first embodiment of the present invention will be described in detail.

As depicted in FIG. 2, the casing 11 is formed as a rectangular or cylindrical shape having an opened upper portion so as to admit laundry. A plurality of supporting rods 12 (only one of which is shown) are installed inside the casing 11 in order to support the outer tub 13, and are equipped with spring so as to have a damping force against movement of the outer tub 13 in the casing 11.

The inner tub 15 rotatively installed inside the outer tub 13 has a cylindrical shape and has a plurality of drainage holes opened to the outside, and the pulsator 17 is installed at the inner bottom portion of the inner tub 15 so as to perform a relative rotation within the inner tub 15.

An upper bearing housing 31 having a generally disk-like shape is fixed to the bottom surface of the outer tub 13, and a lower bearing housing 32 is fixed to the bottom surface of the upper bearing housing 31.

Figure 3:
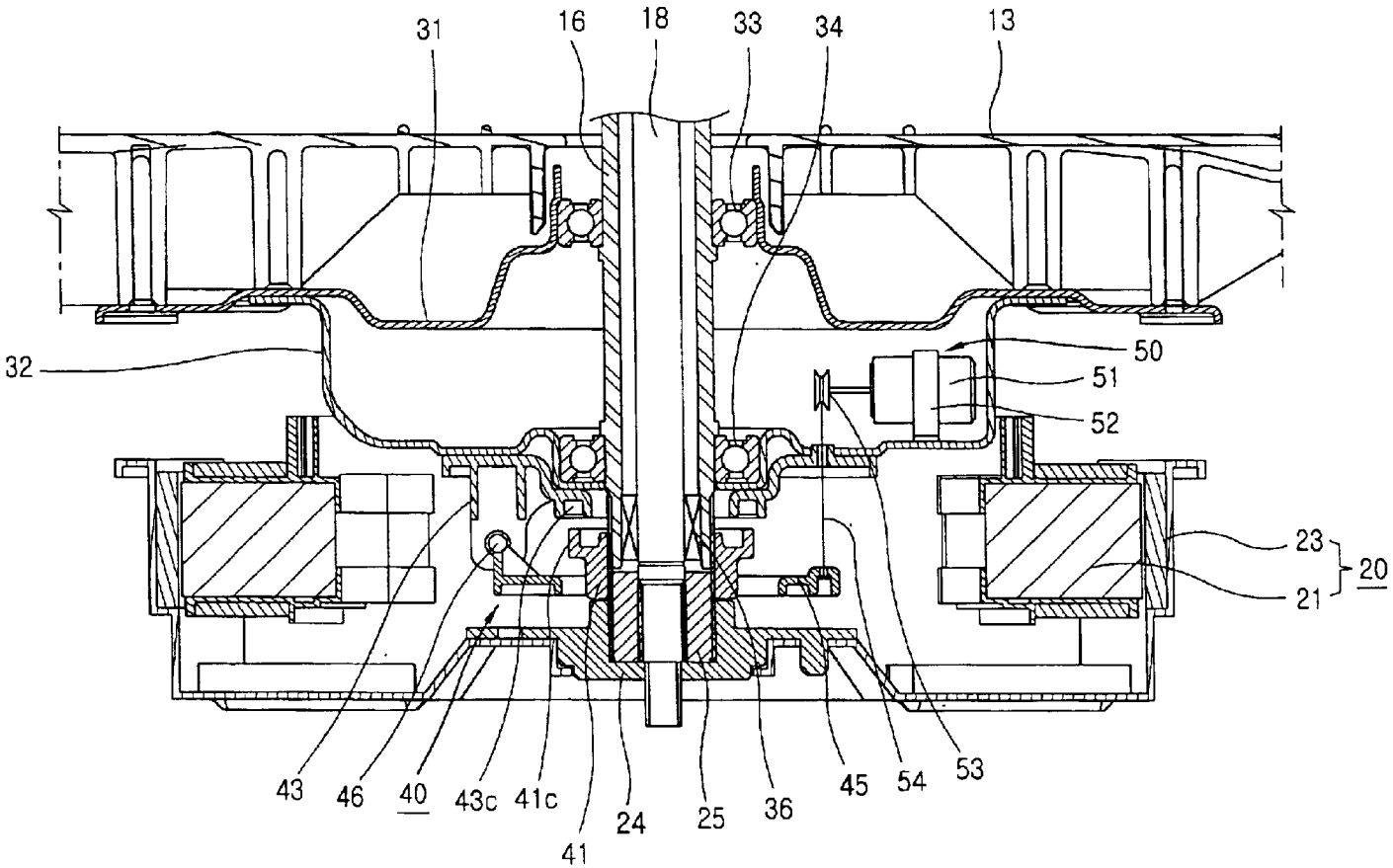
FIG. 3 is an enlarged view illustrating major parts of the direct drive mechanism of the washing machine in FIG. 2.

As depicted in FIG. 3, an upper bearing 33 and a lower bearing 34 are respectively installed at the central portions of the upper bearing housing 31 and the lower bearing housing 32 in order to support the tub shaft 16 rotatively.

The tub shaft 16 has a hollow cylindrical shape in order to house the pulsator shaft 18 inside, and its upper end portion is fixed to the bottom surface of the inner tub 15. And, as depicted in FIG. 4, a plurality of first shaft splines 16*a* are formed at the lower end portion of the tub shaft 16 in order to be connected/coupled with the clutch device 40 by a serrated coupling method.

Oilless bearings 35, 36 are installed inside the tub shaft 16 in order to support the pulsator shaft 18 so as to enable a relative rotation.

The pulsator shaft 18 is formed so as to be longer than the tub shaft 16, herein the upper end portion of the pulsator shaft 18 is fixed to the pulsator 17 as one body, and a plurality of second shaft splines 18*a* formed at the lower end portion of the pulsator shaft 18 are coupled with internal serrations 25*a* in a splined busing 25 so as to rotate as one body.

Figure 4:
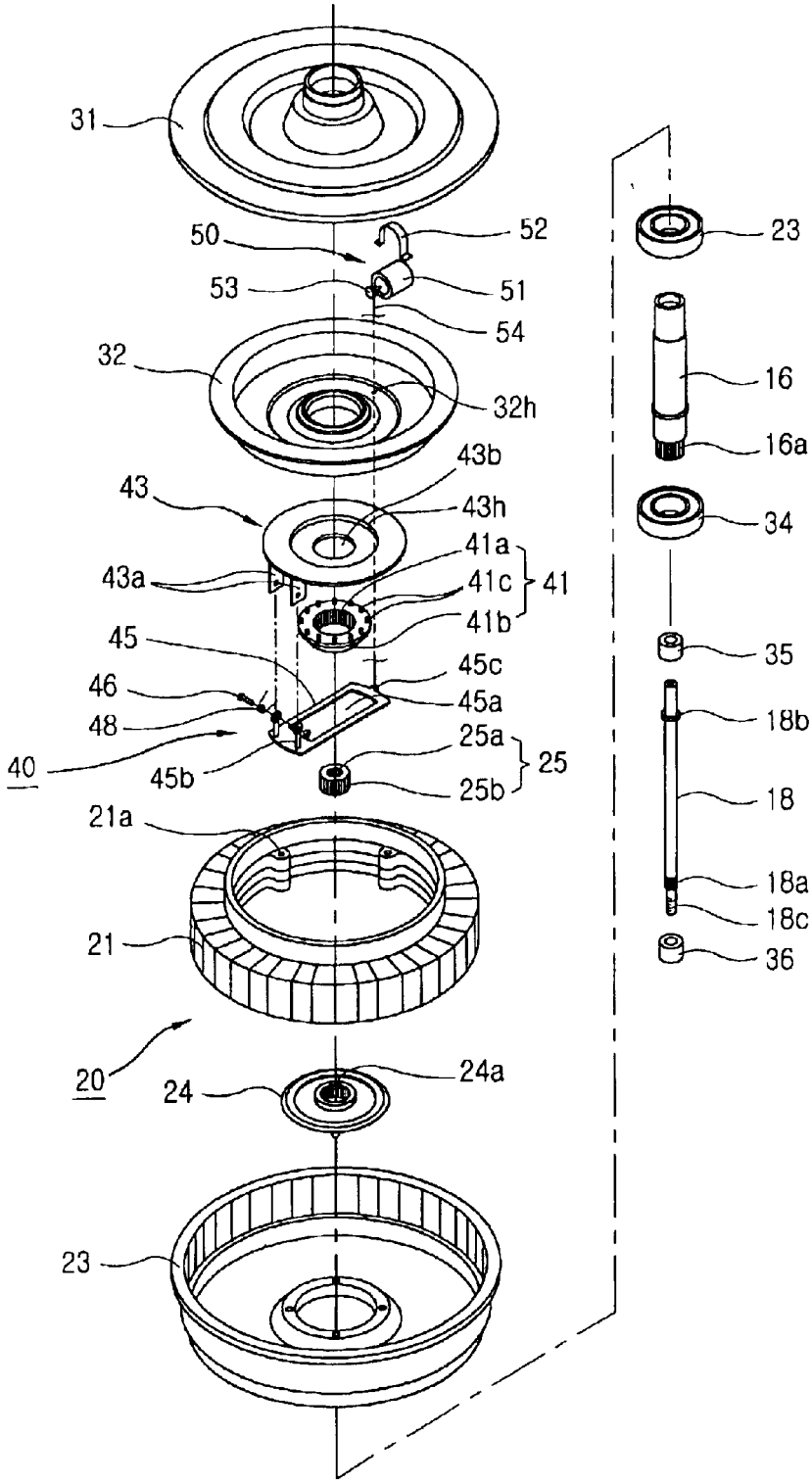
FIG. 4 is an exploded perspective view illustrating the major parts of the direct drive mechanism of the washing machine in FIG. 2.

As depicted in FIG. 4, a ring flanged portion 18*b* is outwardly formed at the upper portion of the pulsator shaft 18 so as to be supported by the oilless bearing 35 in order to be prevent its up and down fluctuation.

The driving motor 20 is constructed with a stator 21 supported by the lower bearing housing 32 and a rotor 23 housing the stator 21 inside and connected with the pulsator shaft 18 at its central portion.

As depicted in FIG. 4, the stator 21 has a ring shape, and a plurality of fixing portions 21*a* are formed at the inner circumference of the stator 21 so as to be fixedly connected with the lower portion of the lower bearing housing 32.

The rotor 23 has a cylindrical shape in order to enclose the contour of the stator 21 with a certain gap therebetween, and a rotor bushing 24 having a disk shape is installed at the central portion of the rotor 23.

A plurality of internal bushing splines 24*a* are formed in the central portion of the rotor bushing 24, and the rotor bushing 24 is coupled thereby to the serrated bushing 25 connected with the pulsator shaft 18 so as to rotate as one body therewith.

In the splined busing 25 having a cylinder shape, a plurality of inner teeth 25*a* are formed at the inner circumference meshing with the plurality of second shaft splines 18*a* of the pulsator shaft 18, and a plurality of outer teeth 25*b* are formed at the outer circumference meshing with the bushing splines 24*a* of the rotor busing 24.

The clutch device 40 includes a coupling 41 located at the outer circumference of the tub shaft 16 so as to be movable up and down, a fixed lever bracket 43 fixed to the lower portion of the lower bearing housing 32, a clutch lever 45 pivotable mounted to the lever bracket 43 and moving the coupling 41 up and down, and a lever operating unit 50 pivoting the clutch lever 45 up and down relative the lover bracket 43.

In the coupling 41 having a cylindrical shape and placed over the outer circumference of the tub shaft 16 so as to be movable up and down therealong, a plurality of coupling teeth 41*a* are formed in an inner circumference thereof so as to engage with the first shaft splines 16*a* of the tub shaft 16 and the outer teeth 25*b* of the splined busing 25.

Herein, the plurality of first shaft splines 16*a* of the tub shaft 16 and the plurality of outer teeth 25*b* of the splined busing 25 are spaced apart so as to have a certain distance therebetween in the axial direction, when the coupling 41 having therein the plurality of coupling teeth 41*a* is moved downwardly while engaging with the first shaft splines 16*a* of the tub shaft 16, the coupling teeth 41*a* of the coupling 41 simultaneously engage with the outer teeth 25*b* of the splined busing 25, and accordingly the rotational force of the driving motor 20 can be transmitted to the inner tub 15.

In addition, a flanged portion 41*b* expanded along the radial direction is formed at the upper portion of the coupling 41 so as to abut the clutch lever 45 when the clutch lever 45 moves up and down, and a plurality of projecting pins 41*c* are protrusively formed at the upper portion of the flanged portion 41*b* arranged in the circumferential direction so as to be combined with the lower portion of the lever bracket 43 when the coupling 43 is moved upwardly.

The lever bracket 43 includes lever coupling portions 43*a* formed at one side of the bottom surface thereof so as to be connected to the clutch lever 45, with a hole 43*b* formed at the central portion thereof so as to pass the tub shaft 16, and a plurality of engaging recesses 43*c* formed around the hole 43*b* in the circumferential direction so as to engage with the projecting pins 41*c* of the coupling 41.

Herein, the projecting pins 41*c* of the coupling 41 and the engaging recesses 43*c* in the lever bracket 43 cooperate for restricting the rotation of the inner tub 15, and the corners of each one chamfered to a rounded structure so as to engage smoothly when they engage with each other in the ascending of the coupling 41.

In the clutch lever 45 placed below the coupling 45 in order to ascend the coupling 41, one end of the clutch lever 45 is pivotably connected to the lever coupling portion 43*a*, and the other end of the clutch lever 45 is connected to the lever operating member 50.

And, in the clutch lever 45, a through hole 45*a* having a rectangular shape is formed so as to pass the cylindrical portion of the coupling 41 and abut on the flanged portion 41*b* of the coupling 41, and bracket coupling portions 45*b* are protrusively formed at the rear pivoted and facing toward the lever coupling portions 43*a* of the lever bracket 43.

As described above, the clutch lever 45 is pivoted centering around a pivot pin 46 connecting the bracket coupling portions 45*b* and the lever coupling portions 43*a* by penetrating though them, and a return spring 48 is installed over the pivot pin 46 in order to provide an elastic force so as to urge the clutch lever 45 downwardly.

The lever operating unit 50 includes a clutch motor 51 mounted inside the upper portion of the lower bearing housing 32 by a motor bracket or clamping band 52 fixing the clutch motor 51 to the lower bearing housing 32, a winding pulley 53 combined with the shaft of the clutch motor 51 as one body, and a wire 54 with its on end is wound around the winding pulley 53 and with its other end connected to the free end of the clutch lever 45.

Herein, in the free end of the clutch lever 45, a connecting portion 45*c* is formed having a hole therein so as to fasten the wire 54, and holes 32*h*, 43*h* are respectively formed in each of the lower bearing housing 32 and the lever bracket 43 so as to pass the wire 54 therethrough.

Operation modes of the direct drive washing machine in accordance with the first embodiment of the present invention will now be described.

First, with the clutch motor 51 is off, supplying of water to the inner tub 15 is performed.

Figure 5:
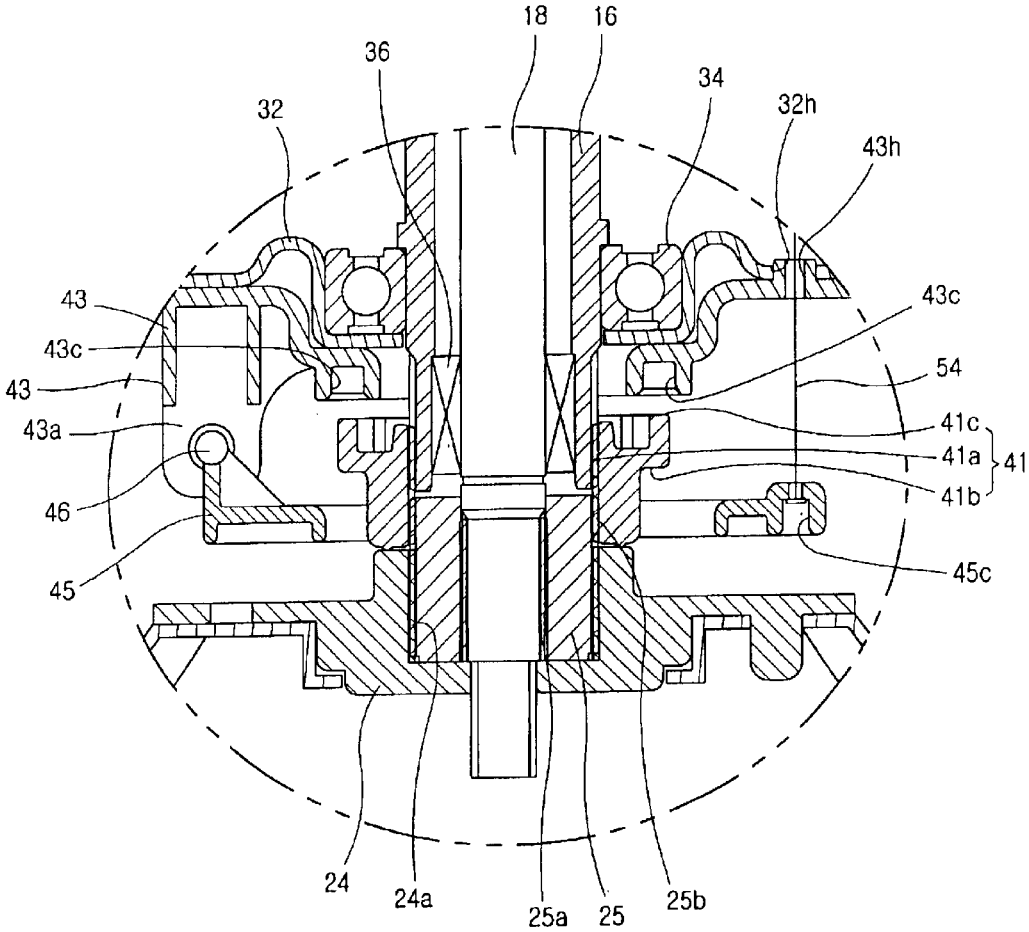
FIGS. 5 and 6 are cross-sectional views which illustrate the operation of a clutch device in the direct drive washing machine of FIG. 2.

Herein, as depicted in FIG. 5, the clutch lever 45 is pivoted downwardly and horizontally placed under its own weight and the urging of the return spring 48, and accordingly the coupling 41 is moved downwardly and simultaneously combined with the first, shaft splines 16*a* of the tub shaft 16 and the outer splines 25*b* of the splined busing 25.

In that state, when the driving motor 20 is operated, the rotational force of, the rotor 23 is transmitted to both the pulsator shaft 18 and the tub shaft 16, whereby the pulsator 17 and the inner tub 15 are gradually rotated at the same time, and thereby wash water supplied inside the inner tub 15 regularly permeates the laundry rotating gradually therein according to the rotation of inner tub 15 and pulsator 17.

Next, in a centrifugal permeating washing, when the clutch motor 51 is off, a centrifugal permeating washing is performed by operating the driving motor 20.

In more detail, as depicted in FIG. 2, when the inner tub 15 and the pulsator 17 are rotated continually in one direction by increasing a rotational velocity of the rotor 23 of the driving motor 20 at a certain level, wash water moved upwardly along the wall of the inner tub 15 and the outer tub 13 crashes against a tub cover 14 and drops back inside the inner tub 15, and accordingly the centrifugal permeating washing can be performed.

Next, when a contamination level of the laundry is low or the quantity of laundry is small or the laundry is of a fine texture, in the power off state of the clutch motor 51, the rotor 23 is rotated normally/reversly, whereby the pulsator 17 and the inner tub 15 are rotated normally/reversly as one body, and accordingly a tub rotating washing can be performed.

On the contrary, when a contamination level of the laundry is high or the quantity of laundry is large, in a power on state of the clutch motor 51, only the pulsator 17 is rotated during the washing.

Figure 6:
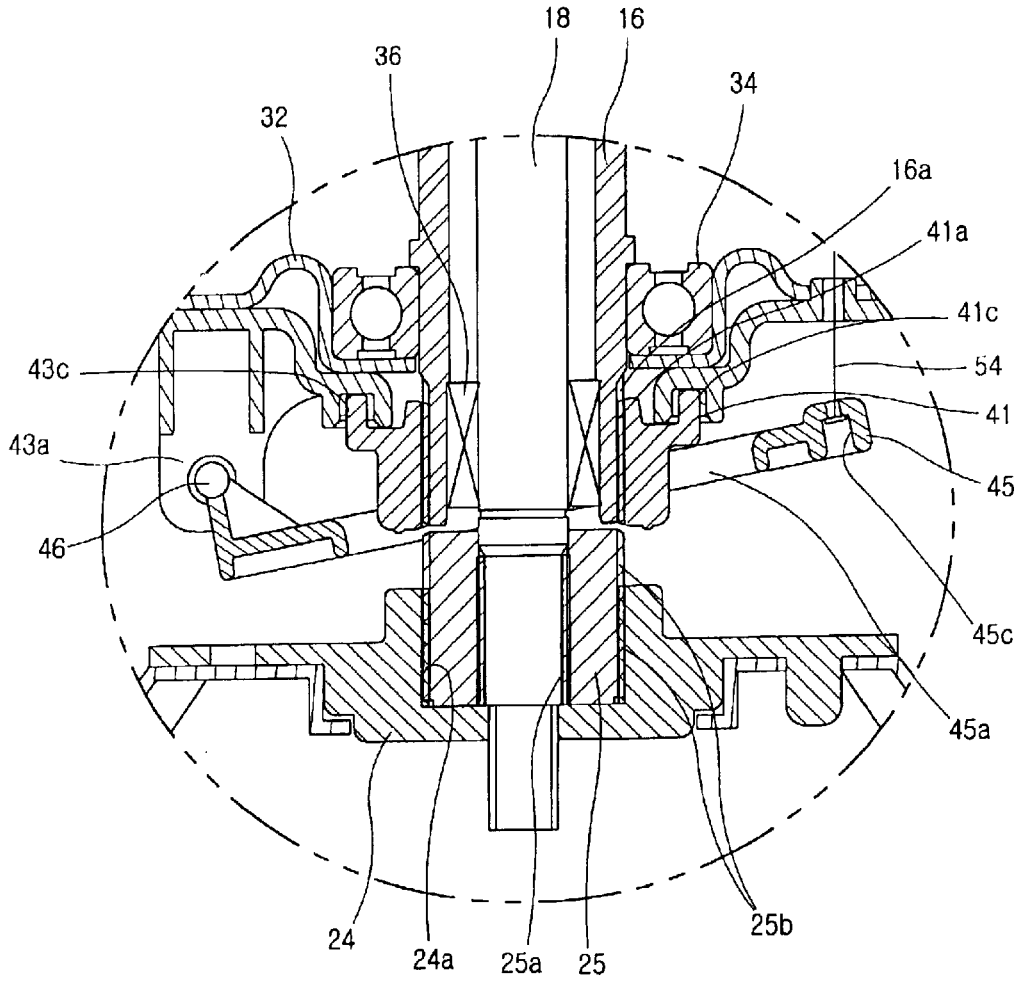

In more detail, when the clutch motor 51 is turned on, as depicted in FIG. 6, the wire 54 is wound around the winding pulley 53, whereby the clutch lever 45 while being pivoted upwardly centering around the coupling pin 46 moves the coupling 41 upwardly, whereby the coupling 41 is separated and thus disengaged from the splined busing 25, and accordingly the rotational force of the driving motor 20 is transmitted only to the pulsator shaft 18 without being transmitted to the tub shaft 16.

In addition, according to the upward moving of the coupling 41, the protruding pins 41*c* of the coupling 41 engage in the engaging recesses 43*c* in the lever bracket 43, and accordingly the rotation of the inner tub 15 due to the inertia force, etc. can be prevented.

In that state, when the rotor 23 is rotated normally/reversly, the inner tub 15 is fixed and stops rotating, so that only the pulsator 17 performs the normal/reverse rotation with the rotor 23 and performs the washing.

In the above-described embodiment, the protruding pins 41*c* are provided at the upper side of the coupling 41, and the engaging recesses 43*c* engaging with the protruding pins 41*c* are formed in the lower side of the lever bracket 43 in order to prevent the rotation of the inner tub 15. However, without providing a plurality of protruding pins at the upper side of the coupling 41 and a plurality of engaging recesses in the lever bracket 43 for holding the inner tub is stationary, a structure performable a relative motion can be constructed.

When the coupling 41 is constructed so as to performable a relative motion about the lever bracket 43, in case of a small quantity of laundry or in case the quantity of wash water is larger than the quantity of laundry, the washing operation can be performed by rotating normally/reversly only the pulsator 17 while almost not rotating the inner tub 15. However, in case if a small quantity of laundry and a small quantity of wash water, the inner tub 15 can be rotated in one direction by a wash water current formed by the pulsator 17, whereby the washing can be performed by reversely rotating the pulsator 17 in order to rotate the inner tub 15 and the pulsator 17 in different directions to each other.

In addition, in case of a large quantity of laundry and a relative small quantity of wash water, the washing is performed by rotating the inner tub 15 according to the effect of rotation of the pulsator 17.

In the above-described embodiment, the return spring 48 is placed at the coupling pin 46 of the clutch lever 45 and the clutch lever 45 is thereby normally urged downwardly. However, it is also possible to move the clutch lever 45 together with the coupling 41 by applying an elastic force directly to the coupling 41.

In the direct drive washing machine in accordance with the first embodiment of the present invention, by selectively rotating the inner tub by moving the clutch lever and the coupling upwardly and downwardly, it is possible to form various wash water currents according to the washing conditions and circumstances, and accordingly the washing efficiency can be improved and the load on the driving motor can be reduced.

Figure 7:
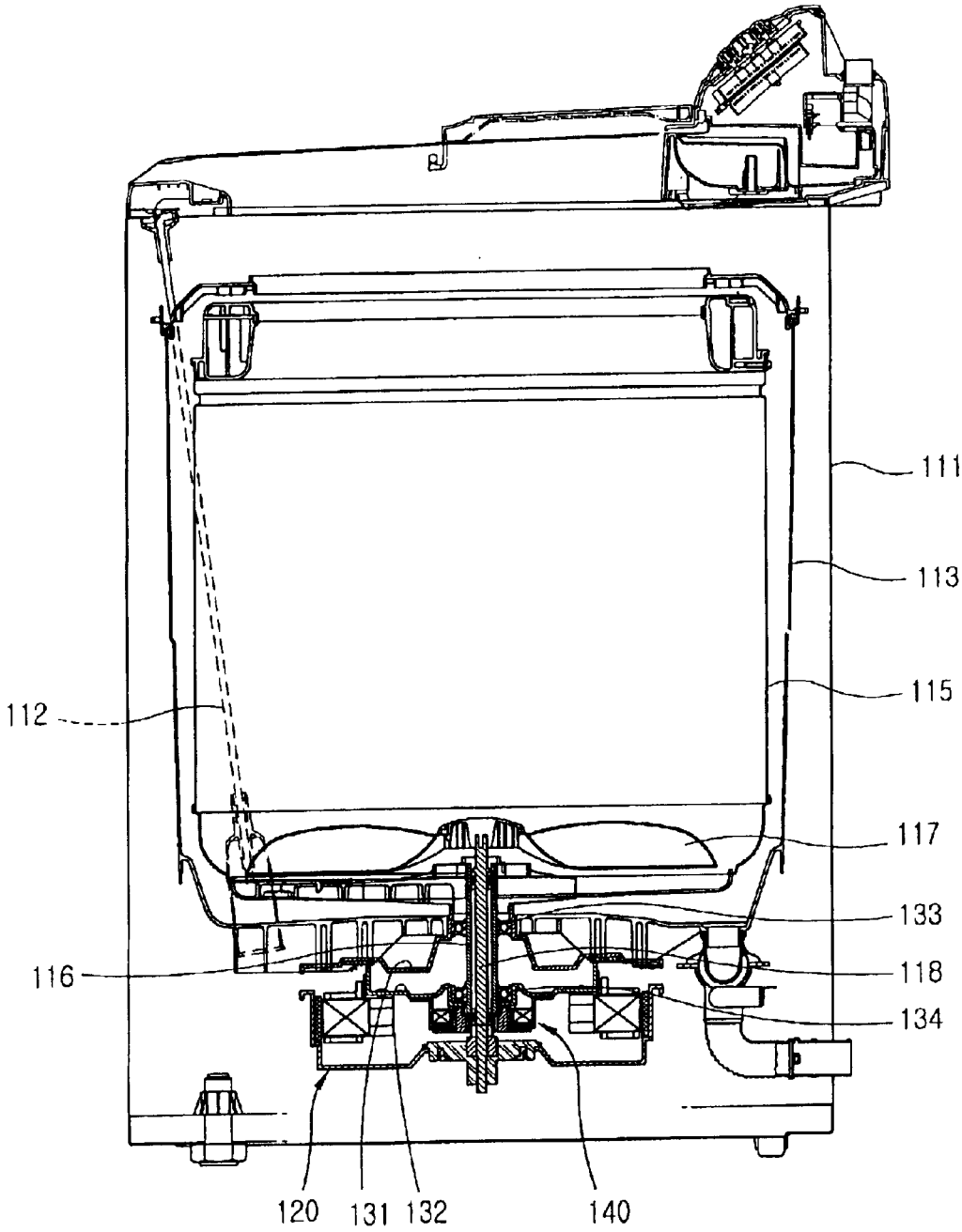
FIG. 7 is a longitudinal cross-sectional view illustrating a direct drive washing machine in accordance with a second embodiment of the present invention.
Figure 8:
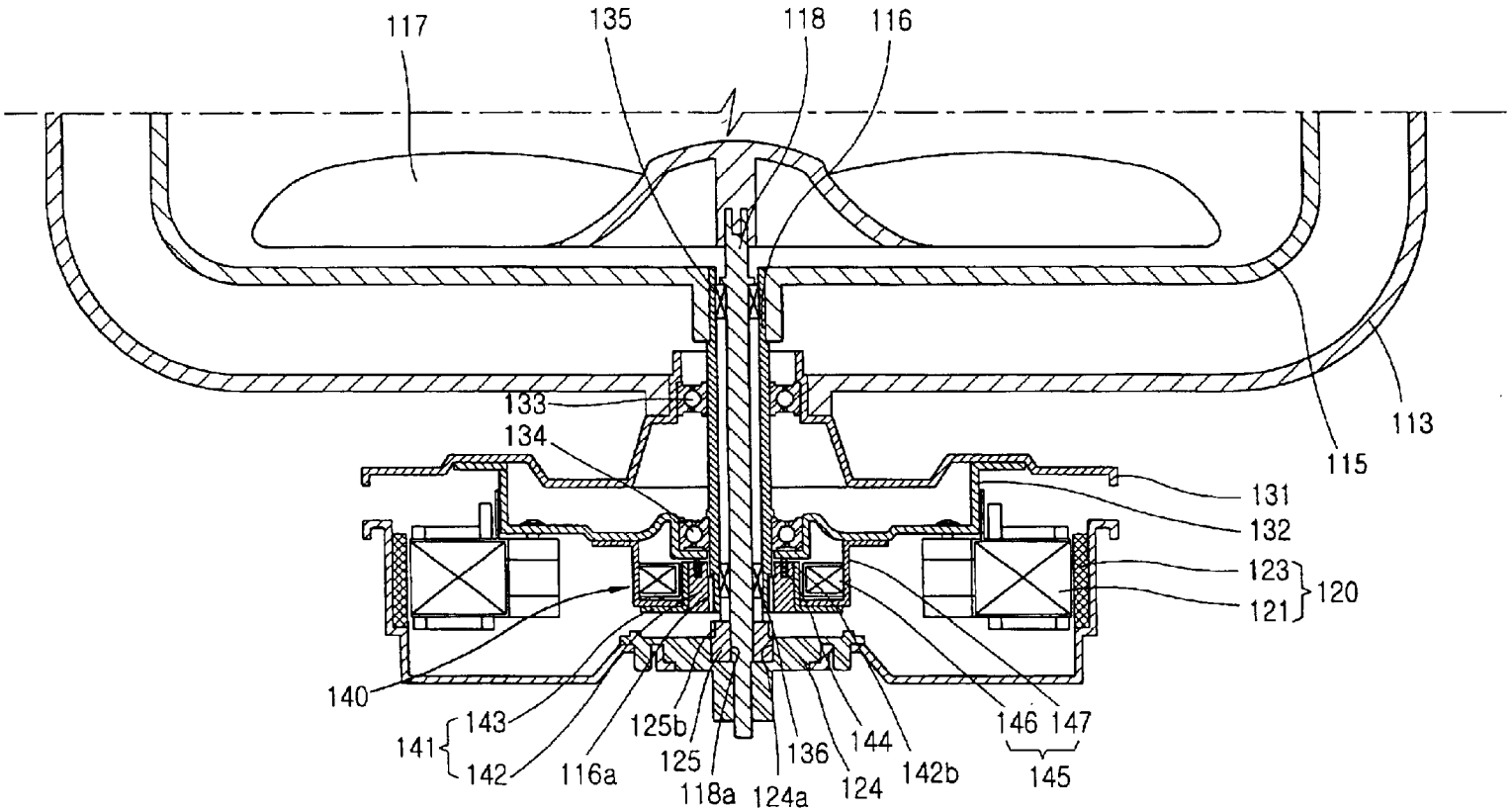
FIG. 8 is an enlarged cross-sectional view illustrating major parts of the direct drive mechanism of the washing machine in FIG. 7.
Figure 9:
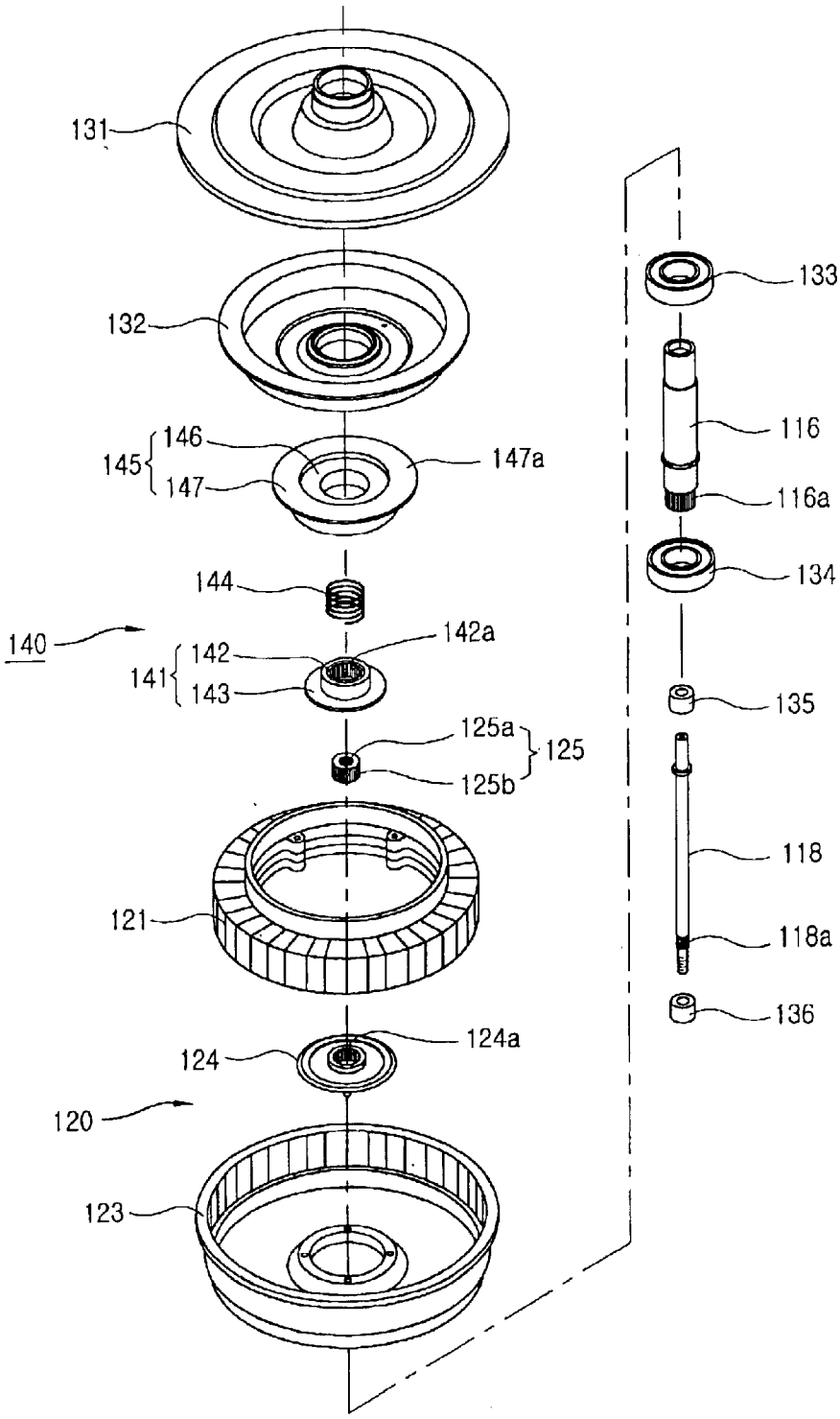
FIG. 9 is an exploded perspective view illustrating the major parts of the direct drive mechanism of the washing machine in FIG. 7.
Figure 10:
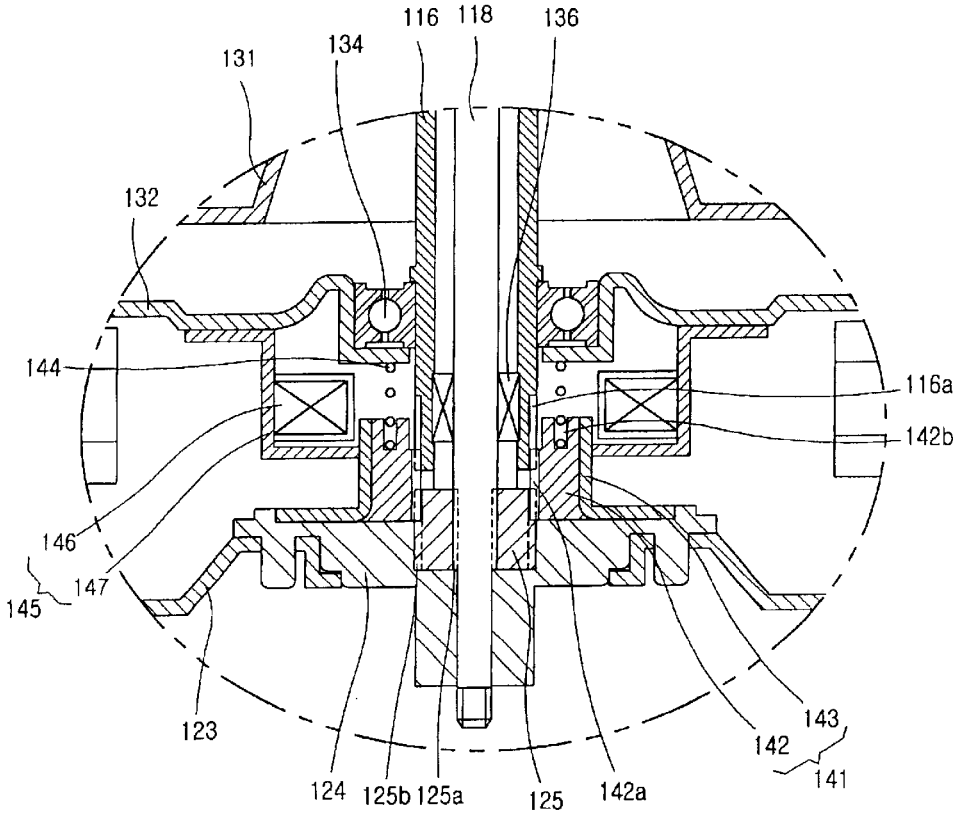
FIGS. 10 and 11 are detailed cross-sectional views which illustrate an operation of a clutch device in the direct drive washing machine of FIG. 7.
Figure 11:
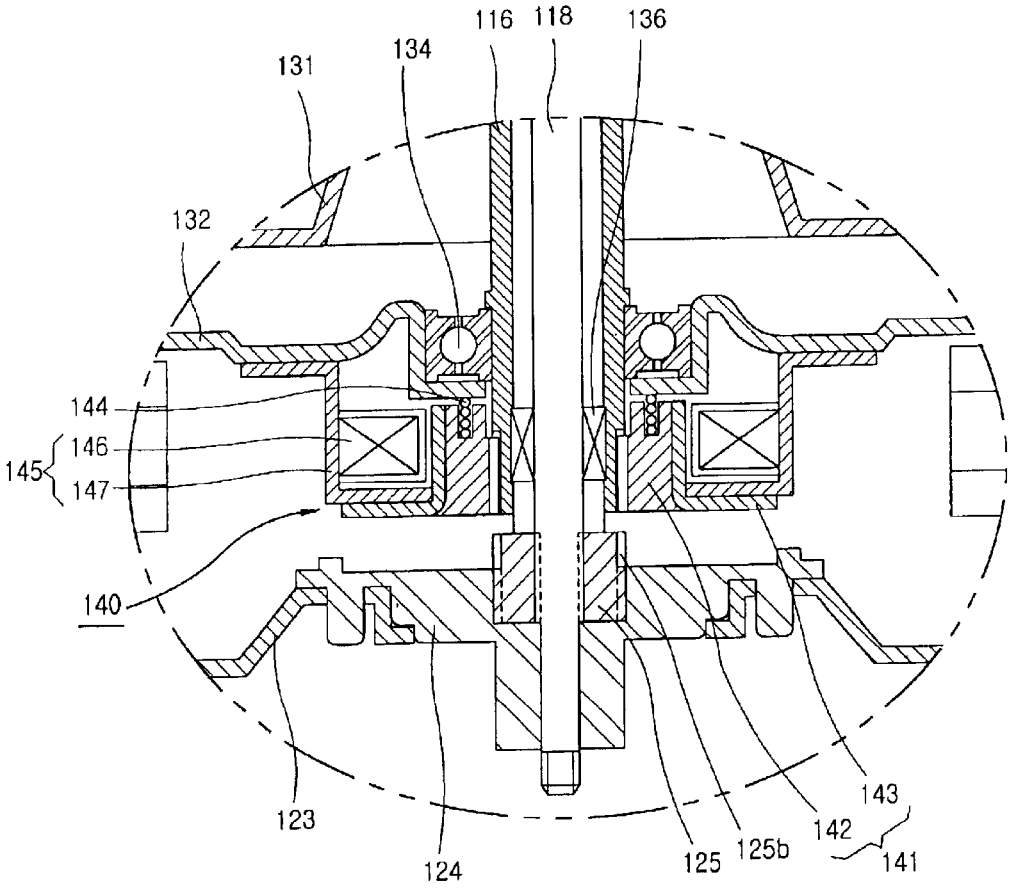

FIGS. 7~11 illustrate a direct drive washing machine in accordance with a second embodiment of the present invention. FIG. 7 is a longitudinal sectional view illustrating a direct drive washing machine in accordance with the second embodiment of the present invention, FIG. 8 is an enlarged view illustrating major parts in FIG. 7, FIG. 9 is a disassembled perspective view illustrating the major parts in FIG. 7, and FIGS. 10 and 11 illustrate an operation of a clutch device in FIG. 7.

In the clutch device in accordance with the first embodiment of the present invention including a clutch motor and a clutch lever, the clutch operation is performed by moving a coupling up and down. On the contrary, in the second embodiment of the present invention, a coupling can moved up and down by using the electromagnetic force of a solenoid actuator.

Major structural parts of the direct drive washing machine in accordance with the second embodiment of the present invention will now be described in more detail.

Herein, the same reference numerals are given to the same parts as in the first embodiment.

As depicted in FIG. 7, the outer tub 113 is installed inside the casing 111 and supported by the plurality of supporting rods 112 so as to have a dampen the transmission of force therebetween.

The inner tub 115 is rotatively installed inside the outer tub 113, and a pulsator 117 is provided at the inside bottom portion of the inner tub 115 so as to be rotatable relative the inner tub 115.

An upper bearing housing 131 is fixed to the bottom surface of the outer tub 113, and a lower bearing housing 132 is fixed to the bottom surface of the upper bearing housing 131.

An upper bearing 133 and a lower bearing 134 are respectively installed in the central portions of the upper and the lower bearing housings 131, 132 so as to rotatively support a tub shaft 116 connected with the inner tub 115.

As depicted in FIG. 8, oilless bearings 135, 136 are installed inside the tub shaft 116 so as to support a pulsator shaft 118 connected with a pulsator 117 to enable it to perform the relative rotation.

Herein, a plurality of first shaft splines 116*a* are formed at the lower end portion of the tub shaft 16 so as to be engageable with a clutch device 140 by a splining engagement method.

And, a plurality of second shaft splines 118*a* are formed at the lower end portion of the pulsator shaft 118 so as to be engaged with a splined busing 125 to be rotatable as one body.

A driving motor 120 is constructed with a stator 121 supported by the lower bearing housing 132, and a rotor 123 enclosing the stator 121 and connected at its central portion with the pulsator shaft 118.

A rotor bushing 124 having a disk shape 124 is installed at the central portion of the rotor 123, and a plurality of bushing splines 124*a* are formed inside a central portion of the rotor bushing 124 so as to be engageable with a splined busing 125 engaged with the pulsator shaft 118.

As depicted in FIG. 9, the splined busing 125 has a hollow cylindrical shape. A plurality of inner splines 125*a* are formed at the inner circumference so as to engage with the second shaft splines 118*a* of the pulsator shaft 118, and a plurality of outer splines 125*b* are formed at the outer circumference so as to engage with the bushing splines 124*a* of the rotor bushing 124.

The clutch device 140 includes a solenoid actuator 145 fixed to a lower portion of the lower bearing housing 132 and generating an elastromagnetic force, a coupling 141 carried on the outer circumference of the tub shaft 116 and selectively transmitting/clocking rotational force by being engaged with/separated from the outer splines 125*b* of the splined busing 125 while being moved by the electromagnetic force of the solenoid actuator 145, and a return spring 144 installed between the coupling 141 and the lower bearing housing 132 and providing an elastic force in order to urge the coupling 141 to return to a home position after being released by the electromagnetic force.

Herein, the solenoid actuator 145 includes a solenoid coil 146 provided at the outer circumference of the coupling 141 and forming a magnetic field, and a solenoid casing 147 fixed to the lower bearing housing 132 and supporting the solenoid coil 146.

The solenoid casing 147 has a disk shape and has a flanged portion 147*a* at its upper part so as to be fixed thereby to the lower bearing housing 132.

The coupling 141 includes a splined coupling part 142 made of a non-magnetic material and engaged with the plurality of first shaft splines 116*a* of the tub shaft 116 by a sliding engagement so as to be engaged with/separated from the plurality of outer splines 125*a* of the splined busing 125, and a magnetic coupling part 143 made of a magnetic material so as to respond to a magnetic force generated by the solenoid coil 146 and fixed to the outer circumference of the splined coupling part 142 in order to move therewith in respond to energization of the solenoid coil 146.

A plurality of coupling splines 142*a* are formed at the inner circumference of the splined coupling part 142 in order to slidably engage with the plurality of shaft splines 116*a* of the tub shaft 116 and the plurality of outer splines 125*b* of the splined busing 125.

As depicted in FIG. 8, a spring retaining groove 142*b* having a circular shape is formed in the upper end portion of the splined coupling 142 so as to receive therein the lower end portion of the return spring 144.

Accordingly, by the opposing operation of the solenoid 145 and the return spring 144, the coupling splines 141*a* of the coupling 141 are engaged with/separated from the outer splines 125*b* of the splined busing 125 while being moved along to the first shaft splines 116*a* of the tub shaft 116 upwardly and downwardly, and accordingly the clutch device 140 can block/transmit the rotational force of the driving motor 120 to the tub shaft 116.

The operation of the direct drive washing machine in accordance with the second embodiment of the present invention will now be described in more detail.

In a similar way to the first embodiment, in case of a centrifugal permeating washing or a washing a small quantity of laundry, in a water supplying operation and a dehydration operation, in order to rotate the pulsator 117 and the inner tub 115 simultaneously, a washing is performed in a "power off" state of the solenoid coil 146.

Herein, as depicted in FIG. 10, the coupling 141 is moved downwardly under the elastic force of the return spring 144 and simultaneously engaged with the first shaft splines 116*a* of the tub shaft 116 and the outer splines 125*b* of the splined busing 125.

In that state, when the driving motor 120 is operated, the rotational force of the rotor 123 is transmitted to the puslator shaft 118 and the tub shaft 116, and accordingly, the washing operation is performed by rotating the pulsator 117 and the inner tub 115 simultaneously.

On the contrary, in case of a high contamination level of laundry or in case of a large quantity of laundry, in order to perform a washing by rotating only the pulsator 117, when power is applied to the solenoid coil 146, as depicted in FIG. 11, the coupling 141 is moved upwardly by the magnetic force generated by the solenoid coil 146.

Here, by separating the coupling 141 from the splined busing 125, the rotational force of the driving motor 120 is not transmitted to the tub shaft 116 but only to the pulsator shaft 118, and accordingly, the washing is performed by rotating only the pulsator 117.

As described above, in the direct drive washing machine in accordance with the second embodiment of the present invention, various operation modes can be performed by rotating or stopping the inner tub 125 according to the washing conditions such as the quantity of wash water or the quantity of laundry, etc., and accordingly, the washing efficiency can be improved and the load on the driving motor can be lowered.

Figure 12:
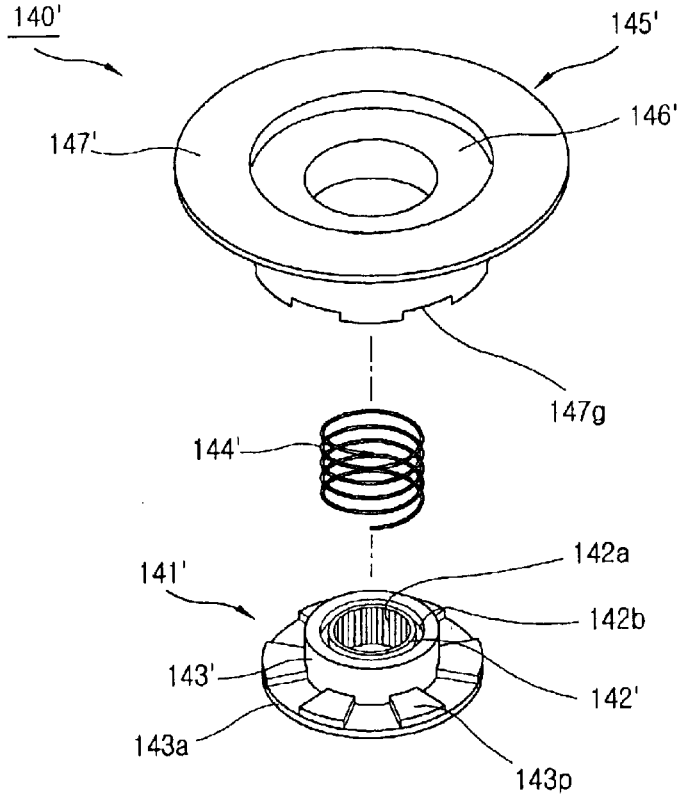
FIG. 12 is an exploded perspective view illustrating a clutch device in accordance with a third embodiment of the present invention.
Figure 13:
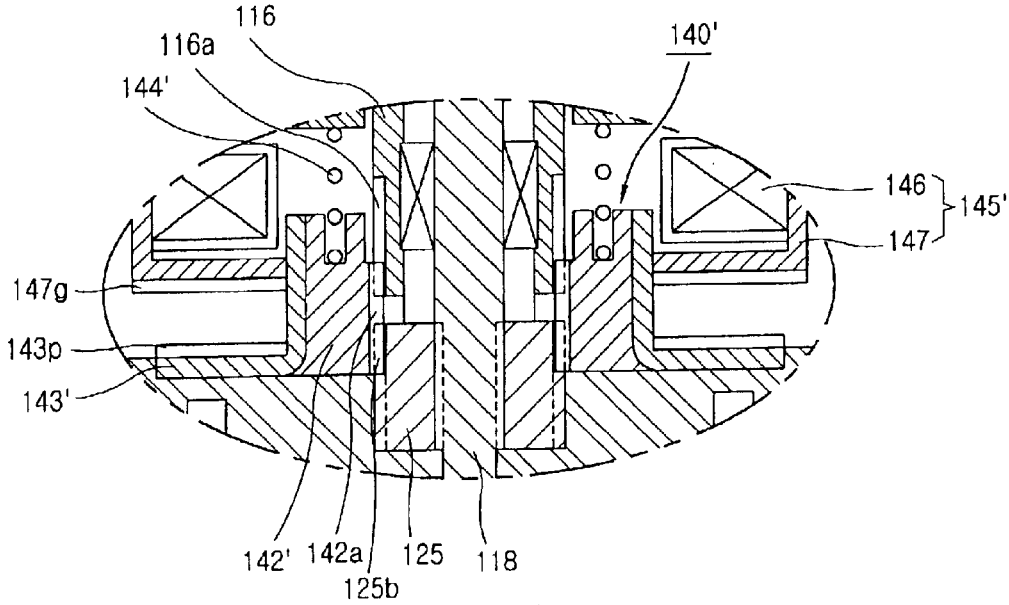
FIG. 13 is a cross-sectional view illustrating the assembled clutch device of FIG. 12.

FIGS. 12 and 13 illustrate a direct drive washing machine in accordance with a third embodiment of the present invention. Herein, FIG. 12 is a perspective view illustrating a clutch device in accordance with the third embodiment of the present invention, and FIG. 13 is a partial cross-sectional view illustrating the clutch device of FIG. 12. Herein, the same or primed reference numerals are given to the same or similar parts as in the second embodiment, and explanation about the same parts will be abridged.

The construction of the direct drive washing machine in accordance with the third embodiment of the present invention is similar to the structure of the direct drive washing machine in accordance with the second embodiment of the present invention. However, it is different in having a tub rotation brake means of a clutch device 140' in order to restrict a rotation of the inner tub 115 by engaging the coupling 141' with the solenoid actuator 145'.

In more detail, in the direct drive washing machine in accordance with the third embodiment of the present invention, as depicted in FIG. 12, a plurality of protruding teeth 143*p* are formed at the upper surface of a flange 143*a*' of the magnetic coupling 143', and a plurality of engaging recesses engaging with the protruding teeth 143*p* are formed at the lower end portion of the solenoid casing 147'.

In the direct drive washing machine in accordance with the third embodiment of the present invention, when power is applied to the solenoid coil 146 of the solenoid actuator 145', the coupling 141' is moved upwardly by the magnetic force by the solenoid coil 146, whereby the protruding teeth 143*p* of the coupling 141' engage with the engaging recesses 147*g* of the actuator 145,' and accordingly, a rotation of the inner tub 115 is prevented.

Accordingly, when the coupling 141' is in a rotation restricted state and the inner tub 115 is thereby in a fixed state, only the pulsator 117 performs the washing operation by rotating normally/reversly together with the rotor 123.

Figure 14:
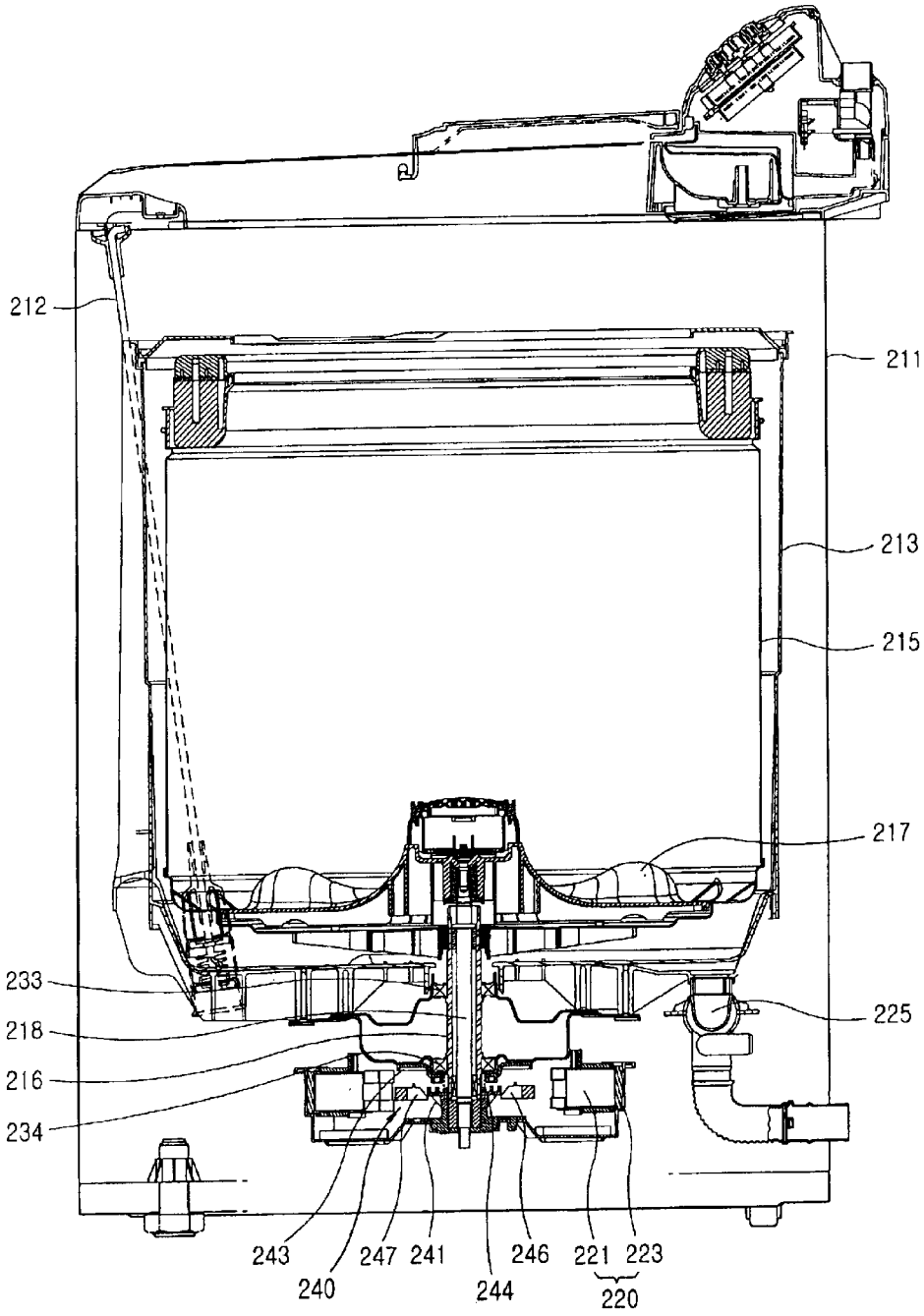
FIG. 14 is a side cross-sectional view illustrating a direct drive washing machine in accordance with a fourth embodiment of the present invention.
Figure 15:
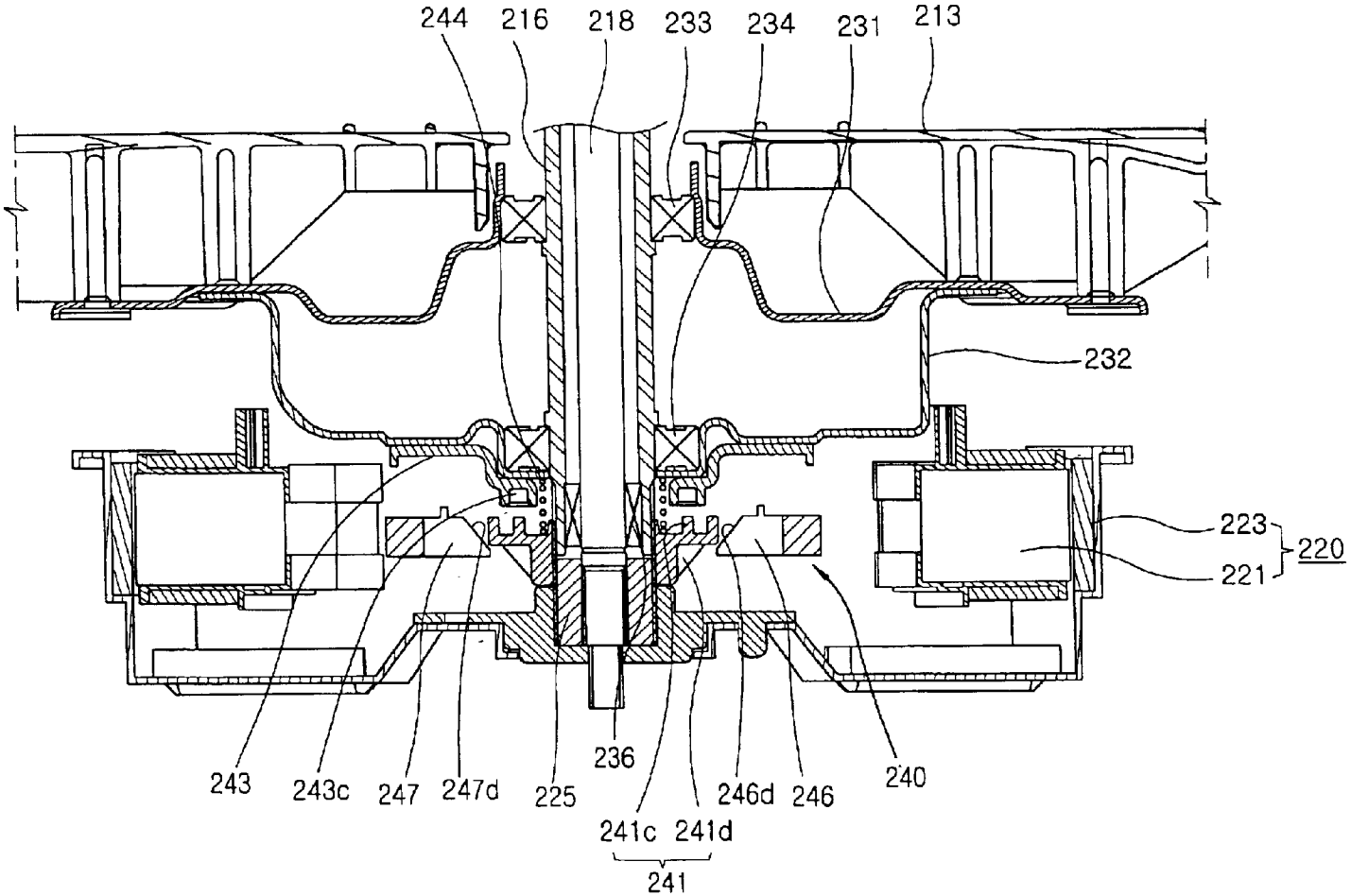
FIG. 15 is an enlarged detail cross-sectional view illustrating major parts of the direct drive washing machine of FIG. 14.
Figure 16:
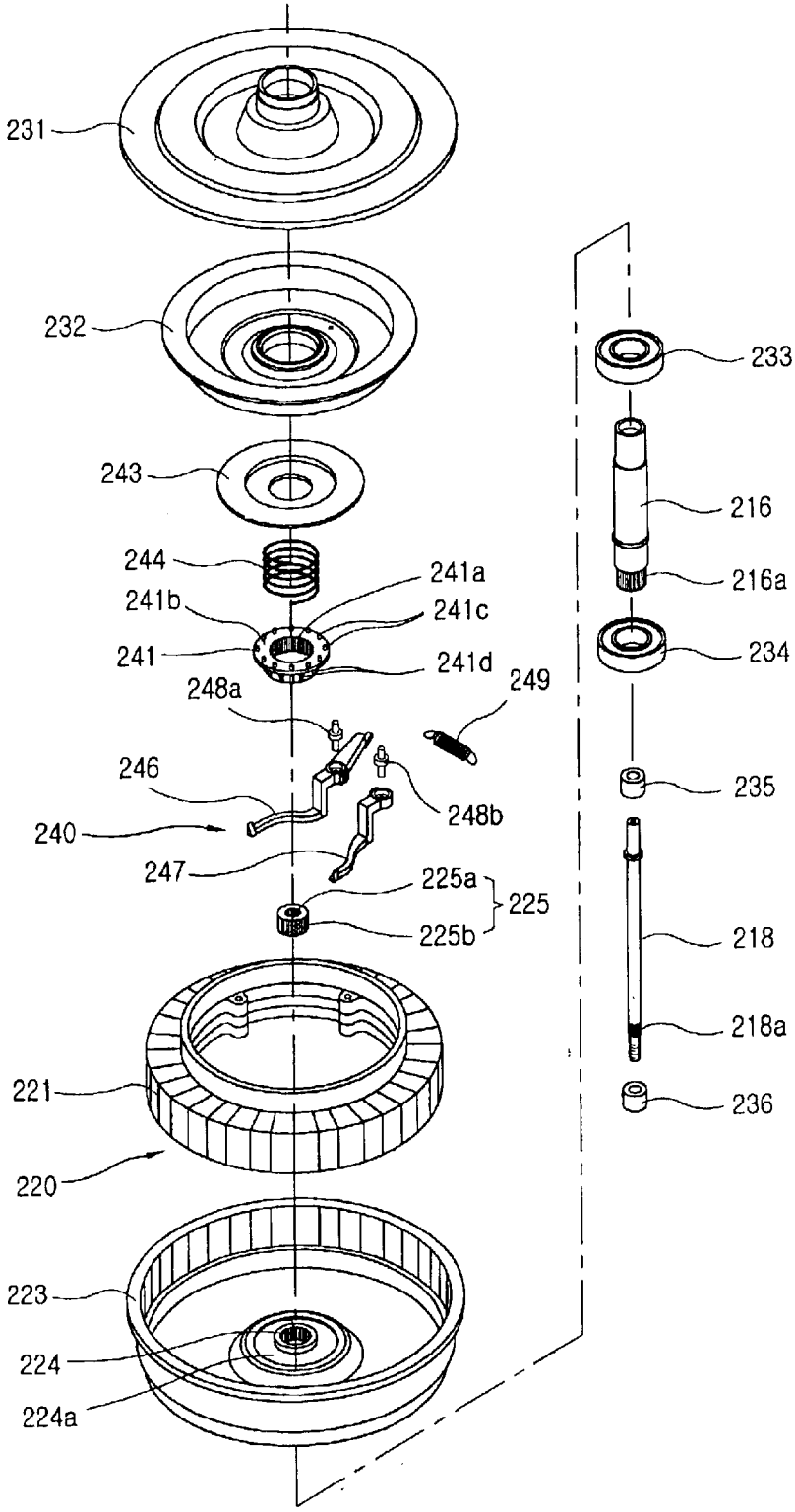
FIG. 16 is an exploded perspective view illustrating the major parts of the direct drive washing machine of FIG. 14.
Figure 17:
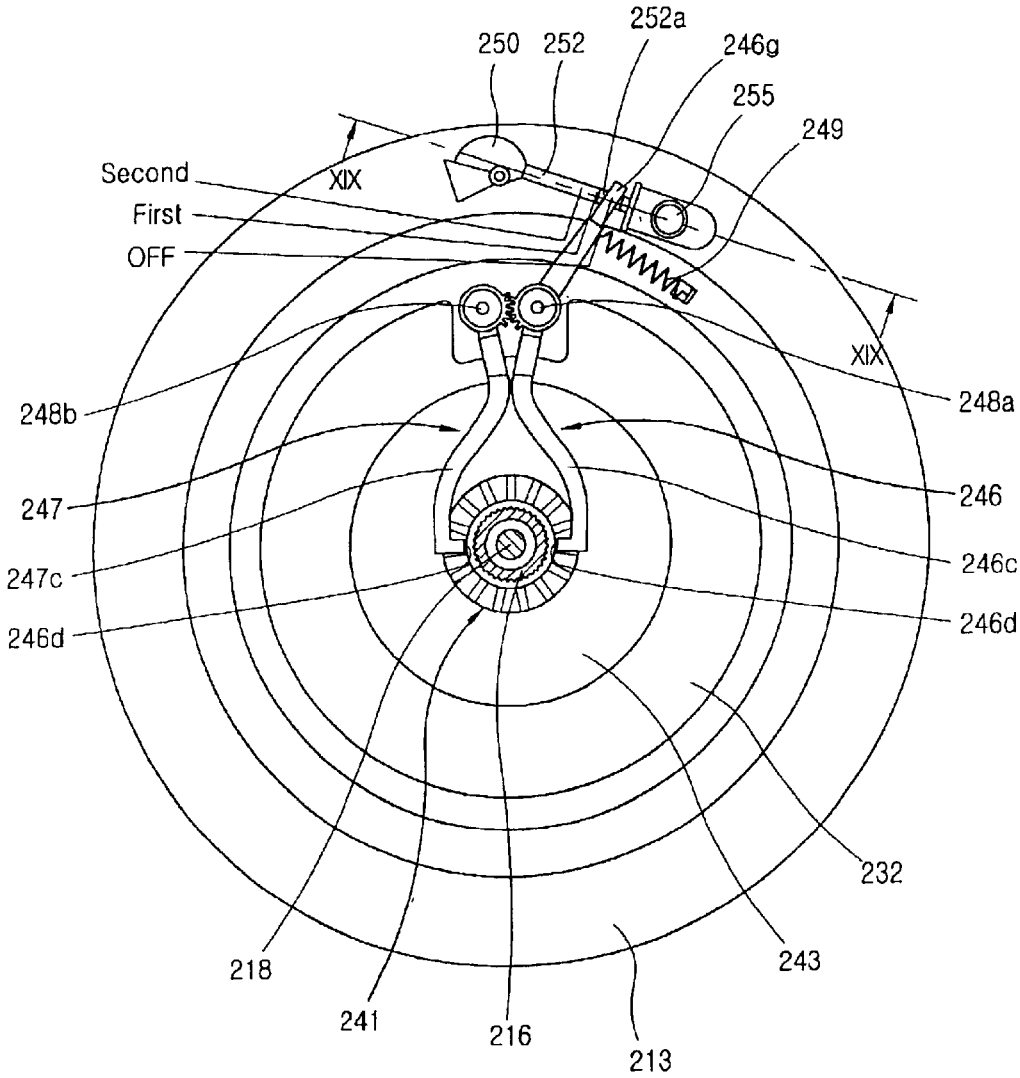
FIG. 17 is a bottom view illustrating a clutch device of the direct drive washing machine of FIG. 14.
Figure 18:
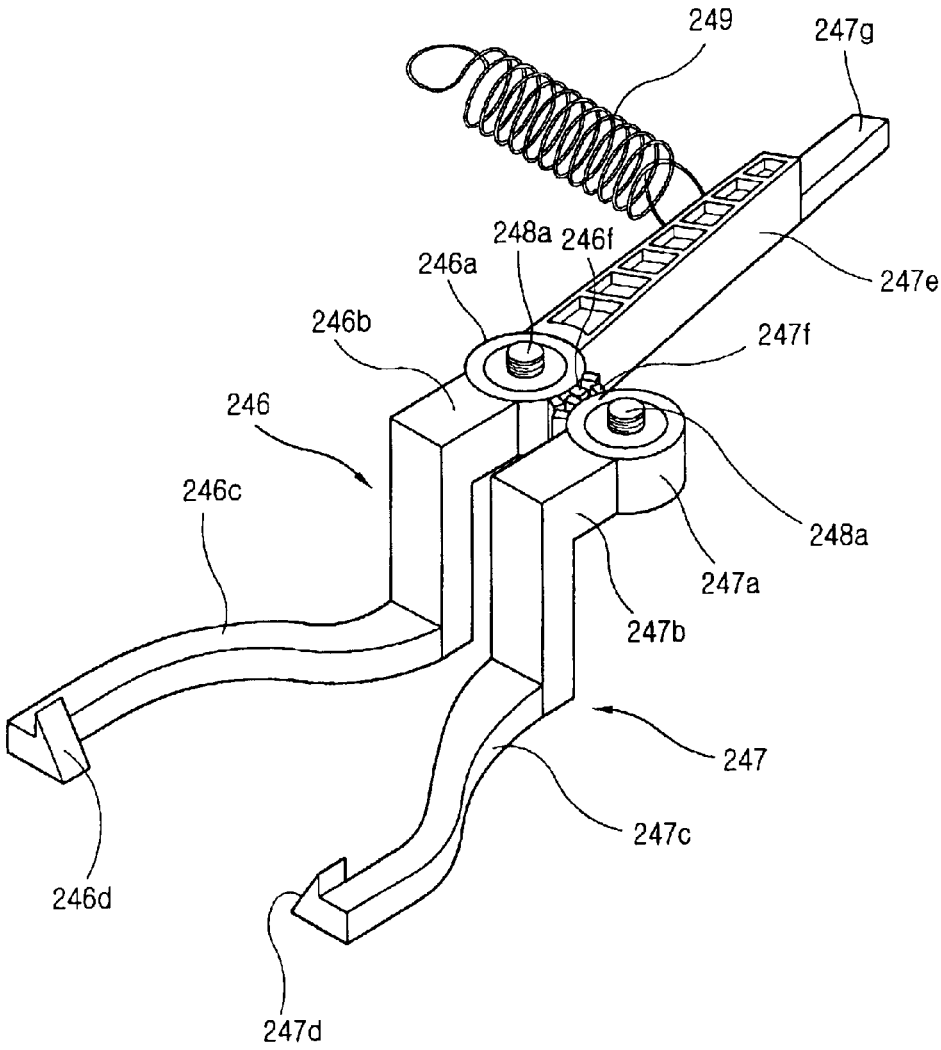
FIG. 18 is an enlarged perspective view illustrating a clutch lever of the clutch device in FIG. 16.
Figure 19:
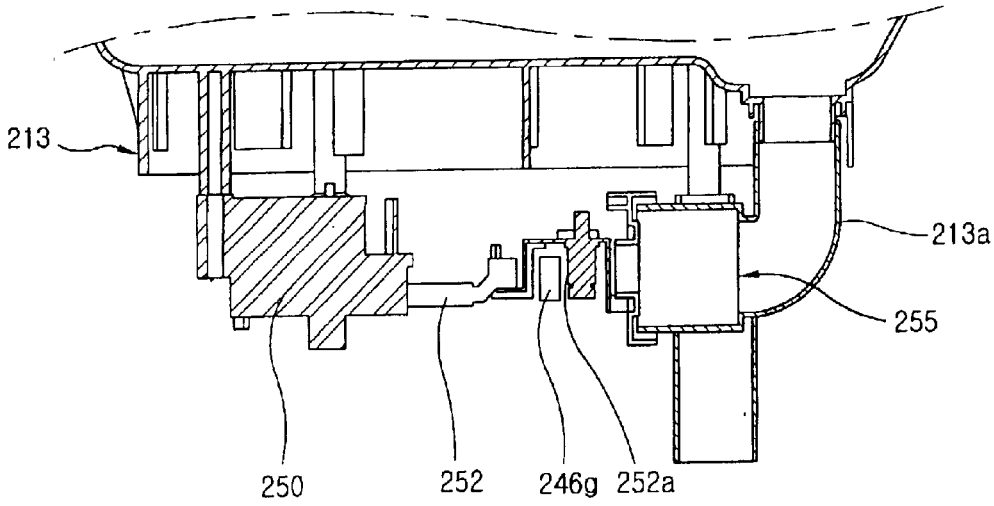
FIG. 19 is a cross-sectional view of the clutch device taken along the line XIX—XIX in FIG. 17.

FIGS. 14~19 illustrate a direct drive washing machine in accordance with a fourth embodiment of the present invention. Herein, FIG. 14 is a longitudinal cross-sectional view illustrating a direct drive washing machine in accordance with the fourth embodiment of the present invention, FIG. 15 is an enlarged view illustrating major parts in FIG. 14, FIG. 16 is a disassembled perspective view illustrating the major parts in FIG. 14, FIG. 17 is a bottom view illustrating an outer tub of a clutch device in FIG. 14, FIG. 18 is an enlarged perspective view illustrating a clutch lever in FIG. 16, and FIG. 19 is a cross-sectional view taken along the line XIX—XIX of FIG. 17.

In the direct drive washing machine in accordance with the second embodiment of the present invention, a clutch device can move a coupling upwardly and downwardly by using the electromagnetic force of a solenoid actuator. But, in the direct drive washing machine in accordance with the fourth embodiment of the present invention, a clutch operation is performed by moving a coupling upwardly and downwardly by using a pair of clutch levers operated by a drain motor.

As depicted in FIG. 14, the direct drive washing machine in accordance is with the fourth embodiment of the present invention includes an outer tub 213 supported inside a casing 211 by a plurality of supporting rods 212, an inner tub 215 rotatably positioned inside the outer tub 213, a pulsator 217 carried in the bottom portion of the inner tub 215 so as to be capable of performing a relative rotation within the inner tub 215, an upper bearing housing 231 and a lower bearing housing 232 respectively fixed to the bottom surface of the outer tub 213, and a driving motor 220 providing a rotational force to the inner tub 215 and the pulsator 217.

An upper bearing 233 and a lower bearing 234 are respectively installed centrally in the upper and lower bearing housings 231, 232 so as to rotatably support the tub shaft 216 combined with the inner tub 215.

As depicted in FIG. 16, oilless bearings 235, 236 are installed inside the tub shaft 216 in order to support the pulsator shaft 218 connected with the pulsator 217 so as to be capable of relative rotation therein.

Here, a plurality of first shaft splines 216*a* are formed at the lower end portion of the tub shaft 216 in order to be engageable with the clutch device 240 by a splined coupling method.

A plurality of second shaft splines 218*a* are formed at the lower end portion of the pulsator shaft 218 in order to be combined with a splined busing 225 so as to rotate as one body.

The driving motor 220 is constructed with a stator 221 supported by the lower bearing housing 232 and a rotor 223 enclosing the stator 221 and connected with the pulsator shaft 218 at its central portion.

A rotor bushing 224 having a disk shape is installed at the central portion of the rotor 223, a plurality of bushing splines 224*a* are formed in the central portion of the rotor bushing 224 so as to be engageable with the splined busing 225 connected with the pulsator shaft 218.

As depicted in FIG. 16, the splined busing 225 has a hollow cylindrical shape, with a plurality of inner splines 225*a* formed at the inner circumference thereof so as to engage with the plurality of second shaft splines 218*a* of the pulsator shaft 218, and a plurality of outer splines 225*b* are formed at the outer circumference thereof so as to engage with the plurality of bushing splines 224*a* of the rotor bushing 224.

The clutch device 240 includes a coupling 241 engageable with/separatable from the splined busing 225 in a state of being connected with the tub shaft 216, first and a second clutch levers 246, 247 pivotably mounted to the bottom surface of the lower bearing housing 232 and moving the coupling 241 upwardly and downwardly while being operated at the both sides of the coupling 241, and a drain motor 250 and a connection link 252 serving as a lever operating means pivoting the first and the second clutch levers 246, 247.

The coupling 241 has a hollow cylindrical shape, with a plurality of coupling splines 241*a* formed at the inner circumference thereof so as to engage with the first shaft splines 216*a* of the tub shaft 216 and the outer splines 225*b* of the splined busing 225, and with a flanged portion 241*b* expanded from the upper portion thereof in the radial direction.

A plurality of upwardly protruding pins 241*c* are provided at the upper surface of the flanged portion 241*b* spaced by a certain distance from each other in the circumferential direction, and a plurality of slanted ribs 241*d* are formed at the side surface of a lower cylinder body portion of the flanged portion 241*b* so as to be inclined downwardly and spaced apart by a certain distance from each other in the circumferential direction.

A coiled return spring 244 is installed to abut at its lower end to the upper portion of the coupling 241 and so as to be supported at its upper end by the lower bearing housing 232 in order to provide an elastic force for urging the coupling 241 to move downwardly.

A fixed bracket 243 is installed to the bottom surface of the lower bearing housing 232 in order to restrict a rotation of the inner tub 215 upon ascending of the coupling 241. A through hole is formed at the central portion of the fixed bracket 243 so as to pass the tub shaft 216, and a plurality of engaging recesses 243*c* are formed in the bottom surface of the fixed bracket 243 around the circumferential direction radially outwardly of the through hole so as to engage with the protruding pins 241*c* of the coupling 241.

As depicted in FIGS. 16~18, first and a second clutch levers 246, 247 are pivotably mounted centering around lever shafts 248*a*, 248*b* arranged parallel with each other along the axial line of the coupling 241, wherein an end portion of each of the first and second clutch levers 246, 247 is movable towards comes up to or recedes from the coupling 241.

As depicted in FIG. 18, the first clutch lever 246 includes a press fit hub portion 246*a* in which the lever shaft 248*a* is pressed-fixed, a vertical leg portion 246*b* downwardly extended from the side of the press fit hub portion 246*a* along the side surface of the lower bearing housing 232, an operating arm portion 246*c* curved slightly from the vertical portion 246*b* and extended nearly at a right angle to it, toward the side surface of the coupling 241 for contacting with the slanted ribs 241*d* of the coupling 241, an extended arm portion 246*e* extended from the press fit hub portion 246*a* at the opposite side from the operation portion 246*c*, and an actuating arm portion 246*g* projecting from the rear end of the extended arm portion 246*e*.

A first toothed sector gearing portion 246*f* is formed at the side of the press fit hub portion 246*a* in the circumferential direction, and a downwardly declined sloping side portion 246*d* is formed at the inner side end portion of the operation arm portion 246*c* so as to contact with the slanted ribs 241*d* of the coupling 241.

As depicted in FIG. 17, a lever spring 249 in the form of a tension coil spring is connected at its one end with the side of the extended arm portion 246*e* and supported at its other end at the outer tub 213 so as to apply an elastic force in order to urge the operating arm portion 246*c* to separate from the slanted ribs 241*d*.

The second clutch lever 247 includes similar a press fit hub portion 247*a* at which a lever shaft 248*b* is pressed-fixed, a similar vertical portion 247*b* downwardly extended from the side of the press fit hub portion 247*a* along the side surface of the lower bearing housing 232, and an operating arm portion 247*c* extended from the vertical portion 247*b* toward the opposite side surface of the coupling 241 and moving the coupling upwardly by contacting to the side surface of the coupling 241.

A second toothed sector gear portion 247*f* is formed at the side surface of the press fit hub portion 247*a* so as to engage with the first toothed sector gear portion 246*f* of the first clutch lever 246, and a slanted surface 247*d* is formed at the inner side end of the operating arm portion 247*c* so as to contact to the slanted ribs 241*d* of the coupling 241.

As depicted in FIG. 19, a drainage hole 213*a* is formed in the bottom surface of the outer tub 213, and a drain valve 255 opening/closing the drainage hole 213*a* is installed at the drainage hole 213*a*.

In addition, a drain motor 250 is installed at the bottom surface of the outer tub 213 so as to open/close the drain valve 255, and a connecting link 252 is connected between the drain motor 250 and the drain valve 255 in order to transmit the driving force of the drain motor 250 to the drain valve 255.

An insertion hole 252*a* is formed in the intermediate portion of the connecting link 252 so as to receive therein the actuating arm portion 246 of the first clutch lever 246.

The operation of the direct drive washing machine in accordance with the fourth embodiment of the present invention will now be described in more detail.

In the supplying of wash water, power is applied to the drain motor 250 in order to move the connection linkage 252 from an off position to a first step position.

Herein, the drain valve 255 maintains a closed state as it is, as depicted in FIG. 17, and according to the transferring of the connection link 252 from the off position to the first step position, the first clutch lever 246 is pivoted in the counterclockwise direction centering around the lever shaft 248*a*, and at the same time the second clutch lever 247 is pivoted in the clockwise direction.

Accordingly, as the operating arm portions 236*c*, 247*c* of the first and the second clutch levers 246, 247 recede from the coupling 241, the coupling 241 is moved downwardly along the first shaft splines 216*a* of the tub shaft 216 and engages with the first shaft splines 216*a* and the outer splines 225*b* of the splined busing 225 simultaneously.

As described above, when the coupling 241 is simultaneously engaged with the tub shaft 216 and the splined busing 225, the rotational force of the driving motor 220 is transmitted to the tub shaft 216 through the coupling 241. Accordingly, because the inner tub 215 is gradually rotated together with the pulsator 221, wash water can regularly permeate the laundry.

In that state, when the driving motor 220 is rotated in one direction continually, a water current ascended by a centrifugal force drops inside the inner tub 215, and accordingly, a centrifugal permeating washing can be performed. In addition, when the driving motor 220 is rotated to the left and right directions in turns, a tub rotation washing can be performed.

In the meantime, in performing washing operation by using only the pulsator 217, power supplied to the drain motor 250 has to be cut off. Then, the first and the second clutch levers 246, 247 being engaged with each other are pivoted in a direction at which the respective operating arm portions 246*c*, 247*c* thereof are tightly closed to the coupling 241 by the elastic force of the lever spring 48.

Herein, the sloping inner end side portion of each of the operation portions 246, 247*c* is tightly contacted to the slanted ribs 241*d* of the coupling 241, whereby the coupling 241 is upwardly displaced and moved by the sloping sides 246*d*, 247*d* of the pertinent operating arm portions 246*c*, 247*c*, and accordingly, the coupling splines 241*a* are slidingly separated from the outer splines 225*b* of the splined busing 225.

Here, the protruding pins 241*c* at the upper surface of the coupling 241 engage in the engaging recesses 243*c* in the fixed bracket 243, and accordingly, the rotation of the coupling 241 and the inner tub 215 is restricted. Therefore, when the driving motor 220 is rotated normally at a certain speed, the rotation of the inner tub 215 is restricted, and the washing is performed by rotating only the pulsator 217 normally/reversely.

In a dehydration process, when power is applied to the drain motor 250, the connecting link 252 is moved to the first step position, whereby the first and the second clutch levers 246, 247 are each pivoted in a direction receding from the coupling 241, and accordingly the coupling 241 engages with the splined busing 225 upon being moved downwardly by the elastic force of the return spring 244.

In that state, when the drain motor 250 is rotated continually and the connection link 252 is moved to the second step position, the drain valve 255 is opened, and the operating arm portion 246*c*, 247*c* of each of the first and the second clutch levers 246, 247 recedes farther from the coupling 241. Here, when the rotor 223 of the driving motor 220 is rotated at a high velocity, the inner tub 215 and the pulsator 217 are rotated as one body, and accordingly the dehydration process can be performed.

In the direct drive washing machine in accordance with the fourth embodiment of the present invention, by providing the plurality of protruding pins 241*c* at the upper surface of the coupling 241 and the plurality of engaging recesses 243*c* in the bottom surface of the fixed bracket 243 so as to engage with the plurality of protruding pins 241*c*, the rotation of the inner tub 215 is restricted. However, in addition, the rotation of the inner tub 215 can be restricted by being combined with an one-way clutch supporting the normal rotation of the tub shaft 216 and restricting the reverse rotation of the tub shaft 216 in a hydration cycle.

As described above, in the direct drive washing machine in accordance with the fourth embodiment of the present invention, by constructing a direct drive washing machine in accordance with the fourth embodiment of the present invention so as to operate a clutch coupling by using a drain motor as usually equipped, various washing modes can be performed according to washing conditions such as the kind of laundry and the quantity of laundry, etc. without using any additional driving device, and accordingly a washing efficiency can be improved.

Figure 20:
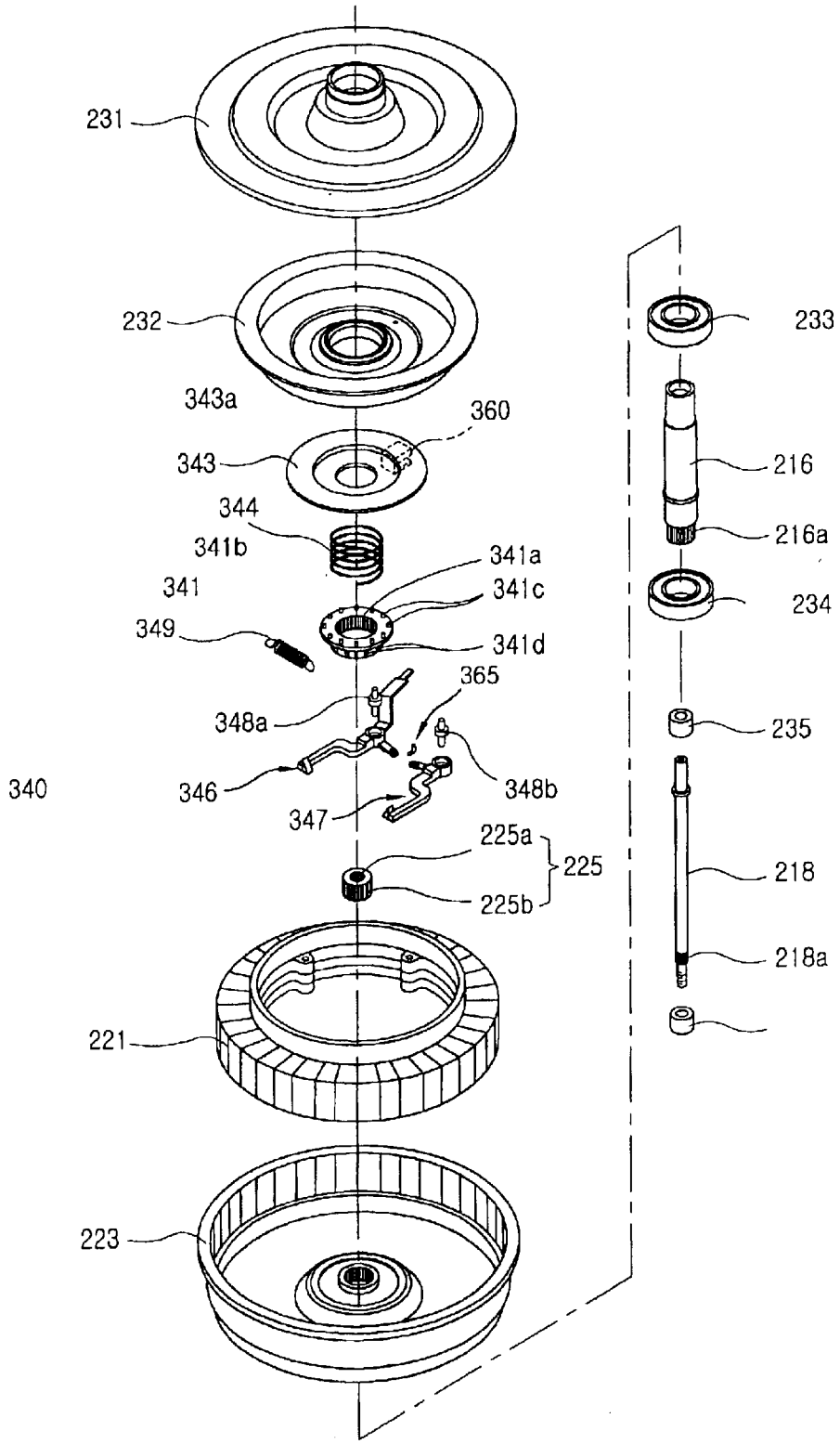
FIG. 20 is an exploded perspective view illustrating a drive mechanism of a direct drive washing machine in accordance with a fifth embodiment of the present invention.
Figure 21:
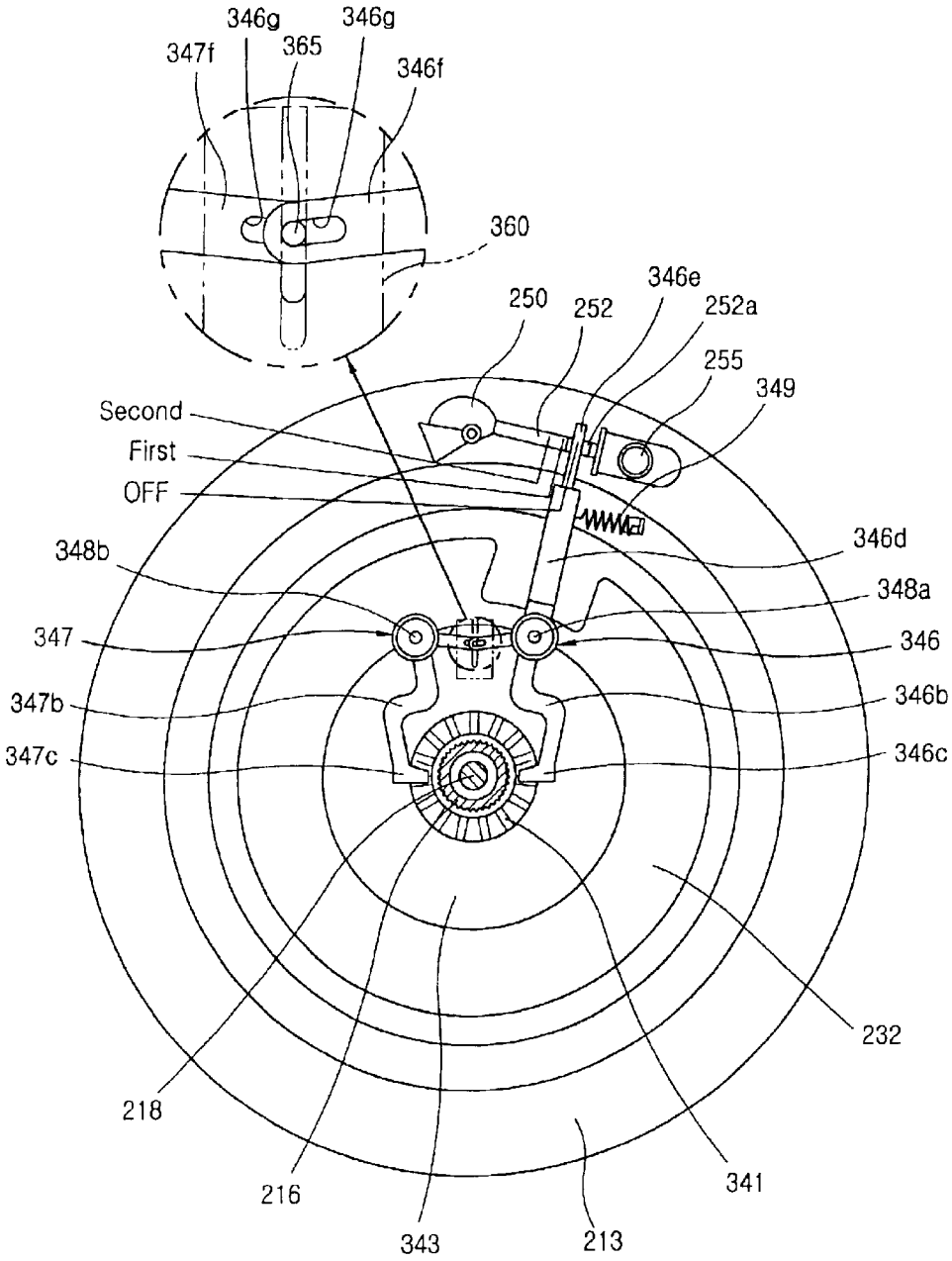
FIG. 21 is a bottom view illustrating a clutch device of the direct drive washing machine in accordance with the fifth embodiment of the present invention.
Figure 22:
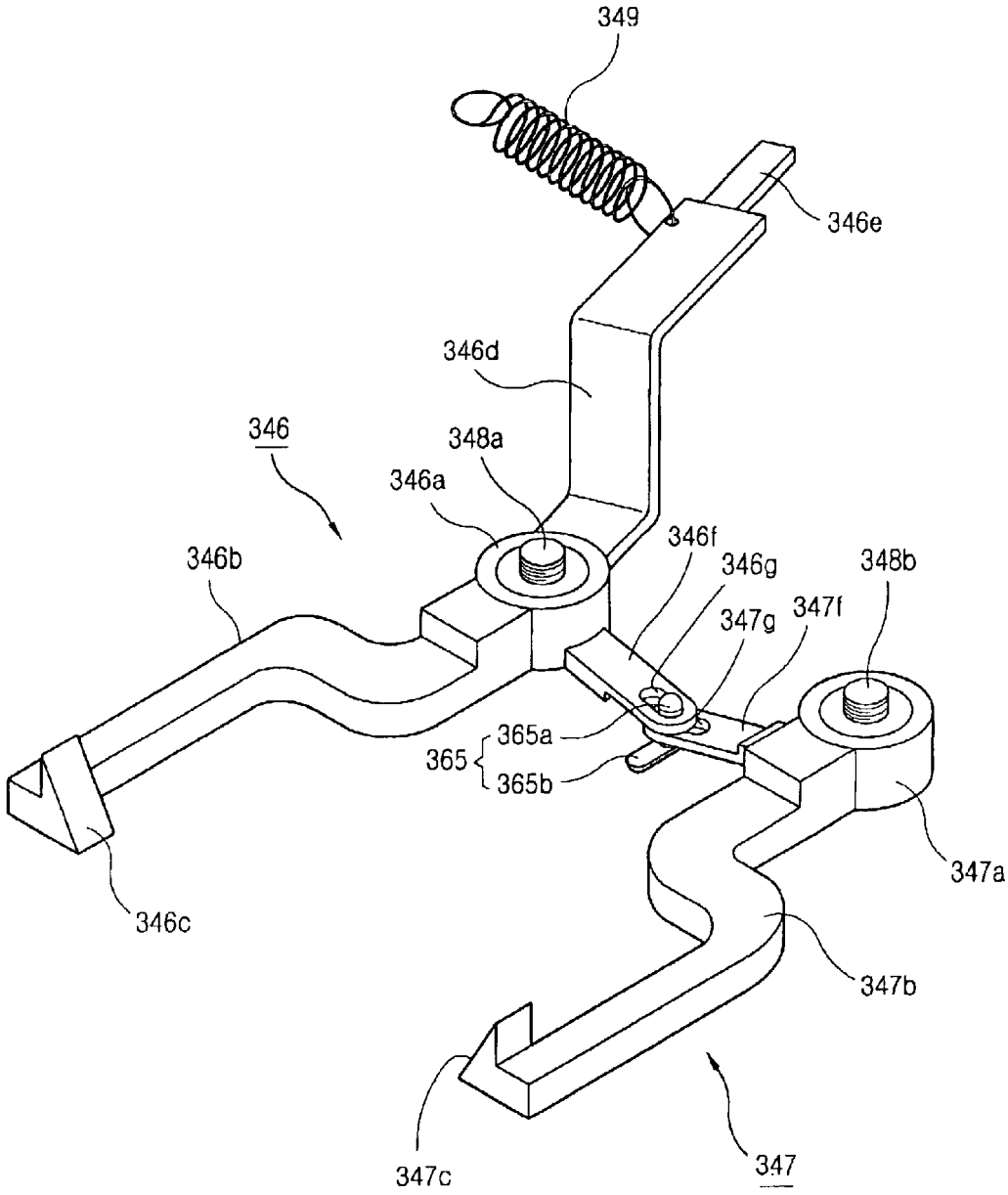
FIG. 22 is a perspective view illustrating a clutch lever of the clutch device of FIG. 20.
Figure 23:
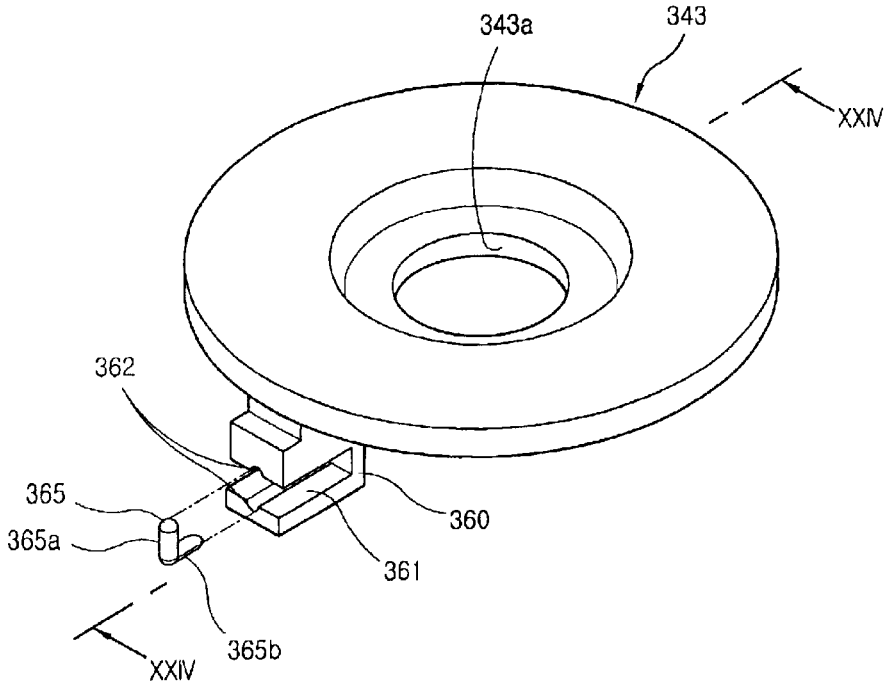
FIG. 23 is a perspective view illustrating a fixed bracket of the clutch device of FIG. 20.
Figure 24:
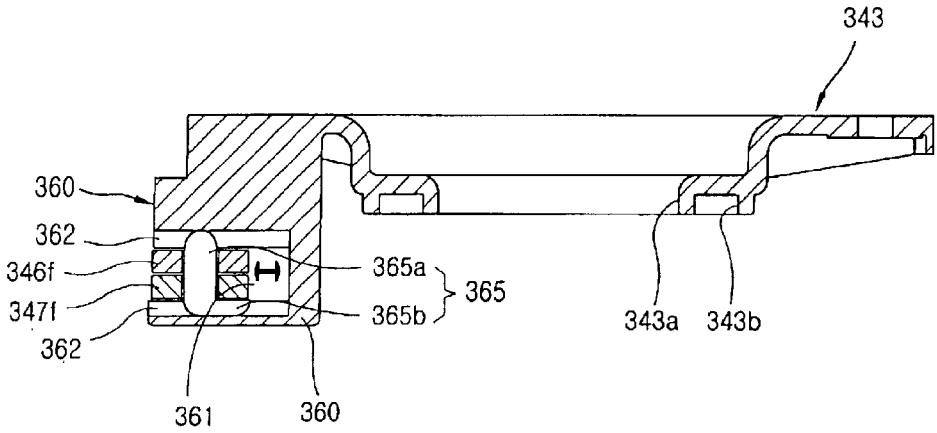
FIG. 24 is a cross-sectional view taken along line XXIV—XXIV in FIG. 23.

FIGS. 20~24 illustrate a direct drive washing machine in accordance with a fifth embodiment of the present invention. Herein, FIG. 20 is a disassembled perspective view illustrating a direct drive washing machine in accordance with the fifth embodiment of the present invention, FIG. 21 is a bottom view illustrating an outer tub of a clutch device of the direct drive washing machine in accordance with the fifth embodiment of the present invention, FIG. 22 is a perspective view illustrating the clutch lever in FIG. 20, FIG. 23 is a perspective view illustrating a fixed bracket in FIG. 20, and FIG. 24 is a sectional view taken along the line XXIV—XXIV of FIG. 23.

In the direct drive washing machine in accordance with the fifth embodiment of the present invention, similarly to the direct drive washing machine in accordance with the fourth embodiment of the present invention, a clutching operation can be performed by moving a coupling upwardly and downwardly by using a pair of clutch levers operated by a drain motor. However, the structure of the clutch lever is different.

Herein, the same reference numerals are given to the same parts as in the earlier embodiment.

In the direct drive washing machine in accordance with the fifth embodiment of the present invention, a clutch device 340 includes a coupling 341 engagable with/separatable from a splined busing 225 while it is engaged with a tub shaft 216, a fixed bracket 343 fixed to the bottom surface of a lower bearing housing 232, first and second clutch levers 346, 347 pivotably mounted to the fixed bracket 343 and moving the coupling 341 up and down while being operated at the both sides, of the coupling 341, and a drain motor 250 and a connection link 252 actuating the first and the second clutch levers 346, 347.

The coupling 341 has a hollow cylindrical shape, with a plurality of coupling splines 341*a* being formed at the inner circumference thereof so as to engage with the first shaft splines 216*a* of the tub shaft 216 and the outer splines 225*b* of the splined busing 225, and with a flanged portion 341*b* expanded from the upper portion thereof in the radial direction.

A plurality of protruding pins 341*c* are provided at the upper surface of the flanged portion 341*b* spaced apart by a certain distance from each other in the circumferential direction, and a plurality of slanted ribs 341*d* are formed at the outer side surface of a lower cylinder body of the flanged portion 341 b so as to be inclined downwardly and spaced apart by a certain distance from each other in the circumferential direction.

A coiled return spring 244 is installed abutting at its lower end to the upper portion of the coupling 341 and at its upper end supported by the lower bearing housing 232 in order to provide an elastic force for urging the coupling 341 to move downwardly.

A fixed bracket 343 is installed to the bottom surface of the lower bearing housing 232 in order to restrict a rotation of the inner tub 215 upon ascending of the coupling 341. A through hole 343*a* is formed in the central portion of the fixed bracket 343 so as to pass the tub shaft 216, and a plurality of engaging recesses 343*c* are formed in the bottom surface of the fixed bracket 343 around the circumferential direction radially outwardly of the through hole 343*a* so as to engage with the corresponding protruding pins 341*c* of the coupling 341.

Particularly, as depicted in FIG. 23, a linkage guide 360 projects radially outwardly from the bottom side of the fixed bracket 343 in order to guide a linear motion of a linkage pin 365. A lever groove 361 is opened in the linkage guide 360 so as to receive therein part of the first and the second clutch levers 346, 347, and guide grooves 362 are respectively formed in the upper surface and the bottom surface of the lever groove 361 for guiding the linear motion of the linkage pin 365.

As depicted in FIG. 22, the first and second clutch levers 346, 347 are mounted for pivoting around respective lever shafts 348*a*, 348*b* arranged parallel to each other along the axial line of the coupling 341, whereby an end portion of each of the first and the second clutch levers 346, 347 can approach and recede from the coupling 241.

The first clutch lever 346 includes a press fit hub portion 346*a* at which the first lever shaft 348*a* is pressed-fixed, an operating arm portion 346*b* extended from the side of the press fit hub portion 346*a* toward the side surface of the coupling 341, a sloping side 346*c* formed at the inner side end portion of the operating arm portion 346*b* so as to lift the coupling 341 by being contacted to the slanted ribs 341*d* of the coupling 341, and a driving lever portion 346*d* extended from the press fit portion 346*a* oppositely to the operating arm portion 346*b*.

A lever spring 349 taking the form of a coil tension spring is connected with the side of the driving lever portion 346*d* so as to apply an elastic force thereto in order to urge the sloping side 346*c* into contact with the slanted ribs 341*d* of the coupling 341, and an actuating arm portion 346*e* is formed at the end of the driving lever portion 346*d* so as to be connected operatably with the connection link 252 of the drain motor 250 for performing a relative motion.

A first link arm 346*f* is extended toward the second clutch lever 347 radially from the press fit hub portion 346*a*, and a pin slot 346*g* accommodating the linkage pin 365 therein is formed at the end of the first link arm 346*f*.

The second clutch lever 347 includes a press fit hub portion 347*a* at which the second lever shaft 348*b* is pressed-fixed, an operating arm portion 347*b* extended from the press fit portion 347*a* toward the side surface of the coupling 341, and a sloping side 347*c* formed so as to be declined at the inner side end of the operating arm portion 347*b* in order to lift the coupling 341 upwardly by being contacted to the slanted ribs 341*d* of the coupling 341.

A second link arm 347*f* is extended from the side of the press fit hub portion 347*a* in the radial direction so as to overlap with the firs link arm 346*f* of the first clutch lever 346, and a pin slot 347*g* is formed at the end of the second link arm 347*f* so as to accommodate the linkage pin 365.

The first link arm 346*f* and the second link arm 347*f* are overlapped with each other inside the lever groove 361 of the linkage guide 360 and connected mutually by the linkage pin 365 carried in the pin slots 58, 60, thus forming a pivoting linkage.

The linkage pin 365 is formed in an 'L' shape, being constructed with a vertical pin portion 365*a* arranged parallel with the first lever shaft 348*a* and a horizontal foot portion 365*b* extended perpendicularly from the lower end of the vertical pin portion 365*a*.

The upper end of the vertical pin portion 365*a* has a hemisphere shape so as to be slidable inside the rounded upper guide groove 362, and the bottom surface of the horizontal foot portion 365*b* is formed so as to have a semicircular shape so as to be slidable inside the rounded lower guide groove 362.

The upper surface of the horizontal foot portion 365*b* is formed as a flat surface so as not to interfere with the first link arm 346*f* and the second link arm 367*f* linked with each other by the vertical portion 365*a*.

As depicted in FIG. 21, a drain valve 255 is installed at the bottom surface of the outer tub 213 in order to discharge wash water.

In addition, a drain motor 250 is installed at the bottom surface of the outer tub 213 so as to open/close the drain valve 255, and a connecting link 252 is connected between the drain motor 250 and the drain valve 255 in order to transmit the driving force of the drain motor 250 to the drain valve 255.

An insertion hole 252*a* into which the actuating arm portion 346*e* of the first clutch lever 346 is received is formed in the intermediate portion of the connecting link 252.

The operation of the direct drive washing machine in accordance with the fifth embodiment of the present invention will now be described in more detail.

In performing an operation for a supplying wash water, power is applied to the drain motor 250 in order to shift the connecting link 252 from its off position to its first step position.

Here, the drain valve 255 is in the closed state, according to the shifting of the connecting link 252 from the off position to the first step position, as depicted in FIG. 21, whereby the first clutch lever 346 is pivoted in the counter-clockwise direction centering around the lever shaft 348*a*, and at the same time the second clutch lever 347 is pivoted in the clockwise direction.

In more detail, when the first clutch lever 346 is pivoted centering around the first lever shaft 348*a*, the second link arm 367*f* which is linked with the first link arm 346*f* by the linkage pin 365 is pivoted correspondingly centering around the second lever shaft 348*b*, and accordingly, the respective operating arm 346*b*, 347*b* of the first and the second clutch levers 346, 347 are spread apart and separated from the coupling 341.

Accordingly, the coupling 341 descends slidingly along the first shaft splines 216*a* of the tub shaft 216 and engages with the splined busing 255, whereby, the rotational force of the driving motor 220 is transmitted to the pulsator 217 and the inner tub 215 simultaneously.

In this state, when the rotational force of the driving motor 220 is increased, wash water moves outwardly by the centrifugal force, moves upwardly through a gap between the inner tub 215 and the outer tub 213 and drops inside of the inner tub 215, and by the circulation of wash water, dissolution of detergent is facilitated, and accordingly, a penetration washing can be performed.

In addition, in the descendent state of the coupling 341, when the driving motor is rotated normally and reversely at a high velocity, the pulsator 217 and the inner tub 215 are rotated normally and reversely as one body, and accordingly, a tub rotating washing can be performed.

In performing a washing operation by using only the pulsator 217, power supplied to the drain motor 250 is cut off. Then, the first and the second clutch levers 346, 347 linked mutually by the linkage pin 365 are pivoted in opposite directions by the elastic force of the lever spring 349, whereby the pertinent sloping inner end sides 346*c*, 347*c* of the operating arms 346*b*, 347*b* are tightly contacted to the coupling 341.

Here, the vertical pin portion 356*a* and the horizontal foot portion 365*b* of the linkage pin 365 are slidably moved along the linkage guides 360, and accordingly, the up and down or right and left fluctuation of the linkage pin 365 can be prevented.

When the sloping inner side 346*c*, 347*c* of each of the first and the second clutch levers 346, 347 is tightly contacted to the slanted ribs 341*d* of the coupling 341, the coupling 341 is moved upwardly thereby, and accordingly the plurality of coupling splines 341*a* are separated from the plurality of outer splines 255*b* of the splined busing 225.

When the coupling 341 ascends fully, the plurality of protruding pins 341*c* engage in the plurality of engaging recesses 343*c* in the fixed bracket 343, and accordingly, the coupling 341 and the inner tub 215 are put in the rotation-restricted state.

In this state, when the driving motor 220 is rotated normally and reversely, the inner tub 215 is in the rotation-restricted state, and only the pulsator 217 performs the washing operation while being rotated normally and reversely.

In performing a dehydration process, when power is applied to the drain motor 250, the connecting linkage 252 is shifted to the first step position, whereby the first and the second clutch levers 346, 347 are pivoted in directions to be separated from the coupling 341, and accordingly, the coupling 341 is moved downwardly by the elastic force of the return spring 344 and engages with the splined busing 225.

In that state, when the drain motor 250 is rotated continually and the connecting link 252 is shifted to the second step position, the drain valve 252 is opened, the sloping sides 346*c*, 347*c* of each of the first and the second clutch levers 346, 347 recedes farther away from the coupling 341. Here, when the rotor 223 of the driving motor 220 is rotated at a high velocity, the inner tub 215 and the pulsator 217 are rotated as one body, and accordingly, the dehydration process can be performed.

In the fourth and the fifth embodiments of the present invention, the first and a second clutch levers can be operated by using a drain motor. However, it is also possible to operate the first and the second clutch levers with an additional operating means such as a driving motor or a solenoid actuator, etc.

In a direct drive washing machine in accordance with the present invention, by selectively rotating an inner tub and a pulsator, various washing modes can be performed in accordance with the kinds and the quantity of laundry, and accordingly, the washing efficiency can be improved and the power consumption can be lowered by reducing a load on the driving motor.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A direct drive washing machine, comprising:

an outer tub housed inside a casing, for storing wash water therein;

an inner tub rotatable inside the outer tub, for receiving laundry therein;

a pulsator rotatable inside the inner tub;

a driving motor installed at a lower portion of the outer tub for rotating the pulsator and the inner tub;

a pulsator shaft directly connected between a rotor of the driving motor and the pulsator;

a tub shaft carried rotatably on the pulsator shaft and connected to the inner tub and separated from the rotor of the driving motor;

a clutch coupling having a sloping side at a lateral surface thereof, connected with an outer circumference of the tub shaft and performing a clutching operation by being combined with or separated from the rotor of the driving motor to move up or down respectively;

at least one clutch lever moving the clutch coupling up or down by being tightly contacted to or separated from, respectively, the sloping side of the clutch coupling; and lever operating means for tightly contacting the clutch lever to the clutch coupling or separating the clutch lever from the clutch coupling.

2. The direct drive washing machine according to claim 1, further comprising:

an elastic member applying a force to the clutch lever in the opposite direction to a force applied from the lever operating means to the clutch lever.

3. The direct drive washing machine according to claim 1, wherein the sloping side of the coupling is constructed with a plurality of slanted ribs separated from each other along the circumferential direction of the coupling.

4. The direct drive washing machine according to claim 1, further comprising a second clutch lever, the at least one clutch lever and the second clutch lever being a pair of clutch levers pivotably fixed to a fixed member of the outer tub and tightly contacted to or separated from both sides of the coupling while pivoting at the same time when the at least one clutch lever is pivoted by the lever operating means.

5. The direct drive washing machine according to claim 4, wherein the pair of clutch levers interlock mutually by respective sector gear teeth at a pivot hub portion thereof so as to engage with each other.

6. The direct drive washing machine according to claim 4, wherein the pair of clutch levers are connected with each other by a pivoting linkage, the pivoting linkage comprising a first link arm and a second link arm respectively extended from each clutch lever so as to face each other, and having a slot at overlapped end portions thereof and a linkage pin connecting the first and the second link arms by being carried in the slot of each of the first and the second link arms so as to enable a relative motion therebetween.

7. The direct drive washing machine according to claim 6, wherein the fixed member includes a linkage guide in order to guide the linkage pin so as to slide linearly.

8. The direct drive washing machine according to claim 6, wherein the linkage pin is formed with an 'L' shape.

9. The direct drive washing machine according to claim 1, wherein the lever operating means includes a drain motor and a connecting link, a drain valve being installed at the bottom surface of the outer tub so as to be opened or closed;

the drain motor being installed at the bottom surface of the outer tub so as to be connected to the drain valve through the connecting link in order to operate the drain valve, the clutch lever being connected to the drain motor and the drain valve through the connecting link so that the lever operating means is operated by a driving force of the drain motor.

10. The direct drive washing machine according to claim 9, wherein the drain motor moves the connecting link to a power off position at which the drain valve is closed and the clutch lever exerts a force pushing up the coupling, a first step position at which the drain valve is closed and the clutch lever does not exert the force pushing up the coupling, and a second step position at which the drain valve is opened and the clutch lever does not push up on the coupling.

* * * * *